US005587760A

United States Patent [19]

Kurata et al.

[11] Patent Number: 5,587,760

[45] Date of Patent: Dec. 24, 1996

[54] AUTOMATIC DEVELOPING APPARATUS USED FOR SILVER HALIDE PHOTOSENSITIVE MATERIAL

[75] Inventors: Noriaki Kurata; Kenji Kuwae, both of Tokyo, Japan

[73] Assignee: Konica Corporation, Tokyo, Japan

[21] Appl. No.: 432,510

[22] Filed: May 1, 1995

[30] Foreign Application Priority Data

May 12, 1994 [JP] Japan ..... 6-098848

[51] Int. Cl.[6] ..... G03D 3/02

[52] U.S. Cl. ..... 396/630; 396/626

[58] Field of Search ..... 354/322–324, 354/331, 336; 221/197; 430/30, 398–400, 450, 465, 493

[56] References Cited

U.S. PATENT DOCUMENTS

| | | | |
|---|---|---|---|
| 4,834,263 | 5/1989 | Becze | 221/197 X |
| 5,318,061 | 6/1994 | Saito | 354/324 X |
| 5,480,768 | 1/1996 | Ishida et al. | 430/399 |
| 5,508,777 | 4/1996 | Isokawa et al. | 354/324 |

FOREIGN PATENT DOCUMENTS

| | | |
|---|---|---|
| 0595312A1 | 5/1994 | European Pat. Off. . |
| 5-107713 | 4/1993 | Japan . |
| 5-107714 | 4/1993 | Japan . |
| 5-107715 | 4/1993 | Japan . |
| 5-119454 | 5/1993 | Japan . |
| 5-127343 | 5/1993 | Japan . |

*Primary Examiner*—D. Rutledge

*Attorney, Agent, or Firm*—Frishauf, Holtz, Goodman, Langer & Chick, P.C.

[57] ABSTRACT

An apparatus for processing a silver halide photographic material with a processing solution comprises a guide passage constructing member provided between a solid agent replenishing device and a processing solution in a tank. The guide passage constructing member forms a guide passage enclosed with an inner wall surface thereof so as to guide a dropped solid processing agent along the enclosed guide passage into the processing solution. The guide passage constructing member is so arranged that a part of the enclosed guide passage is inclined to a horizontal plane and has a ventilating opening to communicate between an enclosed space in the enclosed guide passage and an outer space of the enclosed guide passage.

24 Claims, 18 Drawing Sheets

AUTOMATIC DEVELOPING APPARATUS USED FOR SILVER HALIDE PHOTOSENSITIVE MATERIAL

BACKGROUND OF THE INVENTION

The present invention relates to an automatic developing apparatus used for continuously processing silver halide photosensitive material. More particularly, the present invention relates to a compact automatic developing apparatus in which dissolution work of the solid processing agent is avoided so that the workability can be greatly improved and further excellent photographic characteristics can be stably provided. Further, the present invention relates to an improvement in the replenishment mechanism for replenishing a solid processing agent by which deterioration of the solid processing agent can be prevented and a stable replenishment operation can be carried out.

In general, the processing agent is replenished to an automatic developing apparatus in the following manner: A processing agent kit containing one type or several types of concentrated solutions is previously mixed with and dissolved in water. The thus prepared replenishing solution is stocked in a replenishing tank. In accordance with the throughput of photosensitive material, a small amount of replenishing solution is automatically replenished to the processing tank. In this case, it is necessary to provide replenishing solution tanks, the number of which is the same as that of the types of the processing solutions. In general, the above dissolving work is manually carried out by operators. Accordingly, there is a possibility that mistakes are made in the dissolving procedure, for example, mistakes tend to be made in the type of the processing solution, the amount of dissolving water, and the order of dissolution. Since the processing agent kit contains concentrated chemicals, it is necessary to treat them carefully. For this reason, operators of the automatic developing apparatus have long desired to be released from the dissolving work of replenishing solutions. In order to meet the requirements, several methods are employed, for example, commodities are supplied in the form of a previously prepared replenishing solution, or plural types of concentrated solutions are automatically supplied. However, the aforementioned methods are disadvantageous as described below. According to the former method, the device is more bulky than the kit of concentrated solutions. According to the latter method, it is necessary to provide a complicated device, which is not suitable for a compact automatic developing apparatus called a mini-laboratory. Also, the replenishing solution tank occupies a large space. Therefore, it is difficult to make the automatic developing apparatus to be compact.

In order to meet the demands described above, Japanese Patent Publication Open to Public Inspection No. 119454/1993 discloses a method in which almost all processing agent components are made to be in the forms of solid processing agents, which are directly charged into the processing tank. According to this method, it is not necessary to prepare the replenishing solution, and in accordance with the throughput of photosensitive material, the solid processing agent is directly charged into the processing solution in the automatic developing apparatus by the automatic replenishing device. In this way, the solid processing agent is dissolved. In this case, the solid processing agent is previously stocked in an accommodating section, and a necessary amount of solid processing agent is taken out from there by the automatic replenishing device and charged into the processing solution. However, when the solid processing agent drops onto the solution surface, the solution splashes and scatters, and further vapor generated from the solution surface affects the solid processing agent. These are problems peculiar to the solid processing agent.

Problems are specifically described as follows. Most of the components of the solid processing agent are hygroscopic chemicals. Accordingly, when the solid processing agent absorbs moisture or gets wet with a splash of the solution, the components of the solid processing agent are deteriorated, and further blocks of the solid processing agent stick to each other, that is, the phenomenon of blocking is caused. Furthermore, the processing agent is expanded, and the dimensions are changed and the mechanical strength is lowered. In this way, the performance of the solid processing agent is deteriorated. Due to the foregoing, the sliding property of the solid processing agent is deteriorated, which causes a breakdown of the replenishing device. Unless the processing agent is positively charged into the processing solution, the composition of the solid processing solution can not be appropriately maintained, which could result in a serious problem.

Accordingly, it is most important to prevent the solid processing agent from coming into contact with moisture and humidity. In order to accomplish the above object, various investigations have been made until now.

Japanese Patent Publication Open to Public Inspection No. 107715/1993 discloses a method in which a rotatable floating cover is provided on a solution surface onto which the solid processing agent is charged, wherein the rotational shaft of the floating cover is set on the solution surface. Japanese Patent Publication Open to Public Inspection No. 107715/1993 also discloses a method in which floating globes are arranged on the solution surface. However, this method is disadvantageous in that the processing agent components are deposited on the members when the frequency of charging the solid processing agent is extremely lowered, and operation can not be accurately effected.

Japanese Patent Publication Open to Public Inspection No. 107714/1993 discloses a method in which the solid processing agent is charged into the solution by the replenishing device from a position not opposed to the solution surface. This method is advantageous in that the solid processing agent or the replenishing device is not directly splashed with the solution so that the solid processing agent is not wet with the solution. However, even the outside of the wall of the dissolution tank is splashed, and other processing tanks are stained with the splashed solution. Therefore, it is difficult to perfectly prevent the contamination of other portions of the automatic developing apparatus.

Japanese Patent Publication Open to Public Inspection No. 107713/1993 discloses a method in which the solid processing agent is sent from the replenishing device to an inclined chute and the solid processing agent is slid on the chute to the surface of the solution. According to this method, the dropping speed of the solid processing agent is reduced, and an amount of splash of the solution can be reduced to the minimum. This method is very effective to reduce the splash and moisture given to the solid processing agent.

However, when the dimensions of the dissolution tank are reduced so as to make the automatic developing apparatus compact, an allowable range of the splash zone becomes very small and severe. Therefore, it is difficult to solve the problems by the above method.

The problems will be described in detail as follows. When the dimensions of the dissolution tank are reduced, the splashed solution is deposited on the wall of the dissolution tank. When the processing is continued over a long period of time, an amount of the deposited solution on the wall is gradually increased. In the worst case, the processing solution is sucked upward in the deposited solid component by the capillary action, and the deposited solid component grows upward and finally reaches the outside of the dissolution tank, which causes corrosion of the important parts of the automatic developing apparatus. Due to the corrosion, troubles of the apparatus develop. A mist-like solution tends to splash into other processing solution tank. Accordingly, it is necessary to greatly reduce an amount of splashed solution.

In order to reduce the amount of splashed solution, it is effective to lower the lowermost end portion of the inclined surface, on which the solid processing agent slid, to a position close to the solution surface. However, when the lowermost end portion of the inclined surface is lowered, the inclined surface of the chute gets wet with the splashed solution. When the chute is covered with a tube-shaped member to prevent the chute from getting wet, steam gets into the chute from the solution surface, and dew condensation is caused in the solid processing agent replenishing device. Further, the inside of the chute is subjected to dew condensation, so that the inclined surface on which the solid processing agent passes gets wet. In the process of replenishing operation, the solid processing agent comes into contact with the wet portion of the inclined surface, and the solid processing agent is deposited on the surface, which causes problems, and further the movable portions of the replenishing device can not be driven smoothly, and in the worst case, the chute gets clogged by the deposited solid processing agent.

Another method for reducing the splash of the solution is to reduce an angle of the inclined chute. This method is effective to lower the sliding speed of the solid processing agent on the chute. However, this method is disadvantageous, because there is a possibility that the solid processing agent is caught on the inclined chute surface and the reliability is lowered.

SUMMARY OF THE INVENTION

The present invention has been accomplished to solve the above problems. It is an object of the present invention to provide an automatic developing apparatus for silver halide photosensitive material, the solid processing agent replenishing mechanism of which is improved, so that the moisture absorption of the solid processing agent and the splash of the processing solution can be reduced, and the deposition of the solid processing agent is prevented. Therefore, it is possible to conduct a stable replenishing operation and the photographic performance can be enhanced.

These and other objects, features and advantages of the present invention will become apparent upon a reading of the following detailed specification and drawings.

The above object can be accomplished by the present invention described below.

The automatic developing apparatus for silver halide photosensitive material of the present invention comprises: a solid processing agent replenishing means for directly supplying a solid processing agent into a processing solution; and a guide passage composing member (or a guide passage constructing member) for guiding the solid processing agent supplied from a supply port of the solid processing agent replenishing means to a surface of the processing solution. In this automatic developing apparatus for silver halide photosensitive material, the guide passage composed of inner walls of the guide passage composing member includes a portion inclined with respect to the horizontal surface, and at least one opening for communicating a space enclosed by the guide passage composing member with a space outside of the aforementioned space is provided separately from an outlet opening of the solid processing agent formed in the guide passage. The guide passage constructing member forms an enclosed passage like a conduit by its inner surface.

In this automatic developing apparatus for silver halide photosensitive material, at least one shutter member is provided in the guide passage formed by the guide passage composing member.

In this automatic developing apparatus for silver halide photosensitive material, a space perpendicularly above the surface of the solution onto which the solid processing agent is charged is covered with a canopy-shaped member (a top cover).

In this automatic developing apparatus for silver halide photosensitive material, the guide passage composed of inner walls of the guide passage composing member includes a portion inclined with respect to the horizontal surface, a space above the surface of the solution onto which the solid processing agent is discharged is covered with a canopy-shaped member, and a portion projected upward from a region enclosed by the outlet opening of the solid processing agent guide passage of the guide passage composing member is sheltered by the supply passage composing member.

The solid processing agent used in the present invention is either powdery, granular, pill-shaped or tablet-shaped. From the viewpoints of measurement, prevention of dust and positive charging operation, tablet-shaped solid processing agents are preferably used.

In this specification of the present invention, the processing solution is defined as a solution provided in the processing tank for processing photosensitive materials, or alternatively the processing solution is defined as a solution for directly processing photosensitive materials. That is, the processing solution is clearly distinguished from a replenishing solution that is replenished for maintaining the activity of the processing solution. The solid processing agent may be charged into the processing tank, or alternatively the solid processing agent may be charged into another tank communicated with the processing tank through a pipe. In this case, it is not necessary that another tank is always communicated with the processing tank. Further, the solid processing agent may be charged into a region in the processing tank partitioned off by a filter or others.

In the process of operation or preparation of the automatic developing apparatus, the temperature of the processing solution is adjusted to a predetermined value (normally, at 25° to 50° C.). Therefore, the solid processing agent is charged into the processing solution, the temperature of which is adjusted to this value, and the dissolution of the solid processing agent is facilitated.

The replenishing means for replenishing the solid processing agent of the present invention is defined as a means for controlling an amount of charged processing agent by measuring and discharging the solid processing agent in accordance with a predetermined signal sent from the control section of the automatic developing apparatus. In the present invention, the guide passage composing member is defined as a member for regulating a passage of the discharged solid processing agent sent to the processing solution. In this specification, the guide passage composing member will be referred to as a guide member, hereinafter. From the viewpoint of maintenance, it is preferable that the replenishing means and the guide member are individually independent from each other, however, it is possible to integrate them into one unit by means of molding. The replenishing means of the present invention has the same function as that of the replenishing pump of the automatic developing apparatus of the prior art in which the conventional replenishing solution is used.

In the present invention, the guide passage composed of the inner walls of the guide member is inclined with respect to the horizontal surface, that is, the floor of the guide member corresponding to the inner walls are also inclined with respect to the horizontal surface. Due to the inclined surfaces, the solid processing agent is prevented from freely dropping, so that it slides or rolls on the inclined surface, and the speed of the solid processing agent is controlled. Under the above condition, the solid processing agent advances to the surface of the processing solution. From the above viewpoint, it is preferable that the inclined surface is formed from the inlet opening of the guide member to the outlet opening and that the inclined angle is 30° to 70° with respect to the horizontal surface. The inclination angles of the inclined surface is not necessarily uniform. Inclined surfaces of different inclined angles may be combined, or alternatively a curved surface may be provided.

A similar method to that of the present invention is disclosed in Japanese Patent Publication Open to Public Inspection No. 127343/1993, the dissolution device of which is provided with a plate for straightening a flow of the solid processing agent when the powdery solid processing agent is dissolved to make a replenishing solution. In this apparatus, the drop speed of the solid processing agent is reduced, so that the processing agent storage section is not affected by the splash of the solution. According to this method, it is possible to make a replenishing solution, the temperature of which is not controlled. However, unlike the present invention, according to this method, it is not possible to solve the problem of dew condensation caused by the generation of steam. Therefore, it is impossible to accomplish the object of the present invention by this method. Further, it would not have been obvious to those skilled in the art to achieve the present invention on the basis of the technique disclosed in Japanese Patent Publication Open to Public Inspection No. 127343/1993.

In the case of a tube-shaped guide member (the shape is not necessarily limited to be cylindrical), when an opening is formed on the guide member in addition to an opening from which the solid processing agent is discharged onto the solution surface, the moisture rising from the solution surface does not stay in a space through which the solid processing agent passes, but the moisture flows away outside the guide member through the opening which is formed in the above manner. Therefore, the inside of the guide member is not saturated with steam. Due to the foregoing, an amount of flow of steam is increased, so that the outlet opening of the guide member is maintained in a highly humid condition. Accordingly, the processing solution components deposited on the guide member by splashing are not solidified. In other words, a humidity gradient is formed in the guide passage, so that a rise of moisture to the replenishing device is prevented, and further the deposited components caused by splashing can be removed.

It has been proved that the present invention can also provide the following effects.

It is possible to prevent the deterioration such as coloring of the solid processing agent provided in the solid processing agent accommodating container connected with the solid processing agent replenishing means. It is also possible to prevent the expansion of the solid processing agent caused with the lapse of time.

When a space above the surface of the solution onto which the solid processing agent is charged is covered with a canopy-shaped member, the occurrence of scattering of the processing agent caused by splashing is greatly reduced. Harmful components such as other processing agent components are prevented from being mixed. Therefore, the processing solution performance can be maintained high. However, an amount of steam getting into the guide member increases, which may cause a practical problem. However, when the guide member and other structure of the present invention are used, the problem can be solved. Even when the processing agent components are deposited on a lower surface of the canopy-shaped member, the deposited components are returned onto the processing solution surface by the effect of dew condensation. In this way, accumulation of the deposited components is prevented. Especially when a space above the surface of the solution onto which the solid processing agent is charged is covered with the guide member itself, scattering of the processing solution caused by splashing can be effectively prevented. In this case, the more the space located above the surface of the solution onto which the solid processing agent is charged is covered, the more effect is provided. It is most preferable that the space is completely covered.

In the present invention, the solution surface close to the position (an alighting point) at which the solid processing agent is charged into the processing solution is defined as a portion on the processing solution surface onto which the solid processing agent has been dropped and also a portion on the processing solution surface in the periphery of the aforementioned portion. In the case where a dissolution tank is provided, the portion is limited to a range of the dissolution tank. When the processing solution surface is substantially partitioned off by a filter, a basket for dissolution or a partition wall, this partitioned region may be provided with a canopy-shaped cover. Due to the cover, the occurrence of splash can be reduced when the solid processing agent is dropped on the solution surface.

The more the area of the covered portion is, the more the effect is enhanced. It is preferable that the entire tank (dissolution tank) into which the solid processing agent is dropped is covered with the canopy-shaped member. In this case, even if a heater, a pipe for replenishing water to compensate evaporation, various sensors, filters, holes for attaching parts to the dissolution tank, and gaps formed between the parts and the canopy-shaped cover are provided, the same effect of the present invention can be obtained.

When a portion located above the outlet opening of the guide member is covered with the guide member itself, in other words, when a portion located in an upper portion of the guide member, the portion facing downward, can be seen from the outlet opening, the splash of the solution is caught by the upper ceiling portion of the guide member so that the splash can be prevented from passing through upward.

It is preferable that the lowest portion is located on the projection surface above the outlet opening of the guide member. The reason is described as follows. When the lowest portion is located on the projection surface above the outlet opening of the guide member, drops of water condensed on the ceiling portion of the guide member return to the processing solution surface without dripping on the inclined surface. Further, the splash of the solution caught by the ceiling surface of the guide member can be washed away without staining the inclined surface.

When a shutter member, which is opened when the solid processing agent passes, is provided inside the guide member, the humidity can be maintained high in a portion lower than the shutter member, and also maintained low in a portion higher than the shutter member. That is, the shutter member is effective to increase the humidity gradient. In other words, the shutter member prevents steam from directly coming into contact with the replenishing device arranged above the shutter member. Further, because a portion of the guide member lower than the shutter member is maintained in a highly humid condition, dew condensation occurs, and the splash of the condensation can be effectively washed away. When the shutter member is arranged in a downstream portion of the inclined surface of the guide member, that is, when the shutter member is arranged on the outlet opening side, it is possible to prevent the inclined surface, which directly comes into contact with the solid processing agent, from the occurrence of dew condensation, so that the deposition of the solid processing agent can be prevented. In this connection, the number of shutter members is not particularly specified.

When the outlet opening of the guide member is dipped in the processing solution, the splash of the solution can be suppressed to a minimum, and further the outlet opening portion and its periphery can be maintained in a highly humid condition, which is effective to wash away the deposition.

It is preferable that the passage in the guide member is arranged perpendicular to the solution surface at a position between the outlet opening and the inclined surface. Especially, it is preferable that the passage in the guide member is arranged perpendicular to the solution surface at a position close to the outlet opening portion. That is, the solid processing agent is conveyed as follows. After the solid processing agent has been discharged from the replenishing means, it drops into the guide member and comes into contact with the inclined surface. Then the solid processing agent passes through the substantially perpendicular passage and drops downward. After that the solid processing agent discharges from the outlet opening and arrives on the solution surface. Due to the foregoing structure, an amount of splash onto the inclined surface can be minimized. Since the outlet opening to which the splashed solution is apt to be deposited is arranged to be perpendicular, the deposited solution easily drops, so that the guide passage is prevented from being clogged with the deposited solid solution. Of course, an angle of this perpendicular structure is not limited to a perfect right angle, but the angle may be in a range from 70° to 90°, and it is preferable that the angle is in a range from 80° to 90°. The inclination may be made either inside or outside of the guide member. It is not necessary that the inclination angle is maintained constant. However, it is preferable that the more it comes to the outlet, the more the surface is inclined. For example, it is preferable that the surface is formed to be a curved surface. It is preferable that the angle is sharper than that of the inclined surface for straightening a flow of the processing agent. Further, the surfaces may be continuously formed.

DETAILED DESCRIPTION OF THE PREFERRED EMBODIMENT

Using an example of the present invention, the detailed explanation and the mode of operation of the present invention will be described as follows.

With reference to the accompanying drawings, an example of the present invention will be explained as follows, however, it should be noted that the present invention is not limited to the specific example.

With reference to the accompanying drawings, an example of the automatic developing apparatus of the present invention will be explained.

Figure 1:
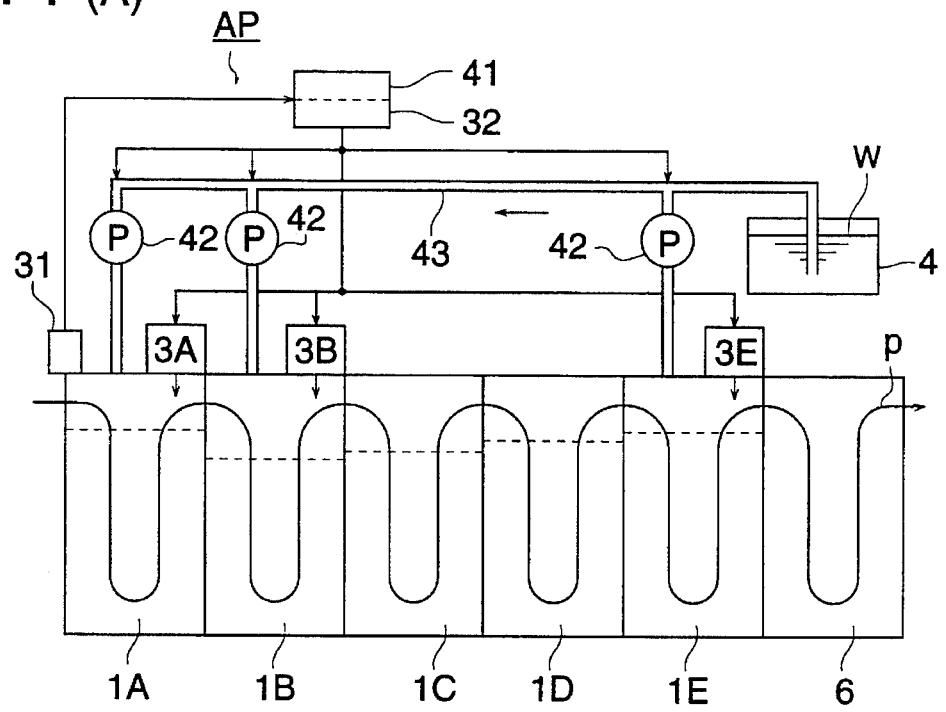
FIGS. 1(A) and 1(B) are arrangement views of the automatic developing apparatus of the present invention.
Figure 1:
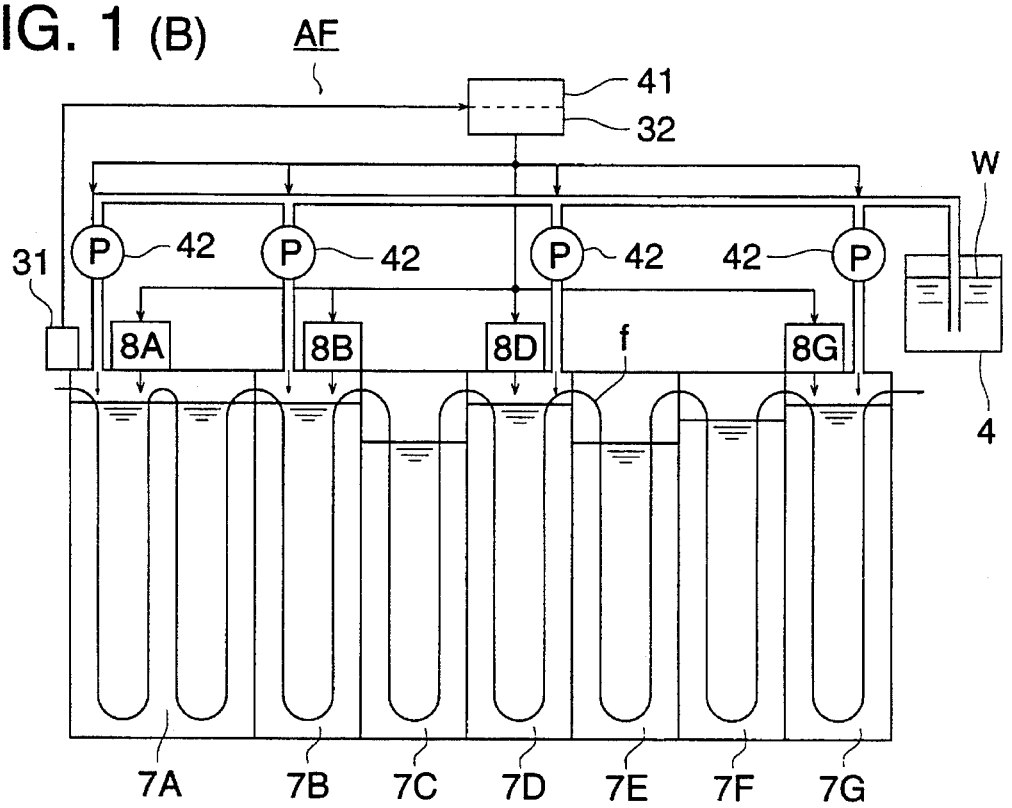

FIG. 1(A) is an arrangement view of the automatic developing apparatus AP for processing sheet-shaped photographic sheets. In the automatic developing apparatus AP, a sheet-shaped photographic paper p is processed by the processing solutions in the color development tank 1A, bleaching and fixing tank 1B, and stabilization tanks 1C, 1D, 1E. After the processing has been completed, the sheet-shaped photographic paper p is dried. As illustrated in FIG. 1(A), the solution levels of the stabilization tanks 1C, 1D, 1E are successively higher than the solution level of the bleaching and fixing tank 1B in this order. Accordingly, an overflowing solution of the tank 1E flows into the tanks 1D, 1C and 1B in this order by the action of gravity, which is called a counter-current system.

FIG. 1(B) is an arrangement view of the automatic developing apparatus AF used for developing negative photographic films. In the automatic developing apparatus AF, a negative photographic film f is processed by the processing solutions in the color development tank 7A, bleaching tank 7B, fixing tanks 7C, 7D, and stabilization tanks 7E, 7F, 7G. After the processing, the negative photographic film f is dried. The color development tank 7A, bleaching tank 7B, fixing tanks 7D, and stabilization tanks 7G are respectively provided with solid processing agent supply devices 8A, 8B, 8D and 8G. In this connection, the replenishing water tank 4 is substantially composed in the same manner as that illustrated in FIG. 1(A). Therefore, the same reference character is used.

FIG. 2(A) is an overall arrangement view showing the structure of a silver halide photosensitive material processing apparatus (printer processor) in which the automatic developing apparatus A and photographic printer B are integrated into one body.

In FIG. 2(A), in the left lower portion of the photographic printer B, there is provided a magazine M in which a roll of photographic paper (color paper), which is an unexposed silver halide photographic material, is accommodated. The photographic paper p is pulled out from the magazine M and conveyed by the feed rollers R1 and cut into a predetermined size by the cutter $C_t$. In this way, a sheet of photographic paper p can be provided. This sheet of photographic paper p is conveyed by the belt conveyance means Be. Then an image of the original O is exposed onto the sheet of photographic paper p by a light source and lens L in the exposure section E. The exposed sheet of photographic paper p is further conveyed by a plurality of pairs of feed rollers R2, R3 and R4, so that the sheet of photographic paper p is introduced into the automatic developing apparatus AP. In the automatic developing apparatus AP, the sheet of photographic paper p is successively conveyed by a roller conveyance means (the reference numeral is not attached to the means) into the color development tank 1A, bleaching and fixing tank 1B and stabilizing tanks 1C, 1D, 1E, wherein these tanks substantially compose a processing tank 1. Due to the foregoing, the sheet of exposed photographic paper p is subjected to color development, bleaching and fixing processing and stabilizing processing. After the processing has been completed, the sheet of photographic paper p is dried by the drying section 6, and then discharged outside of the apparatus.

In this connection, the one-dotted chain line in the drawing shows a conveyance passage of the photographic paper p. In this example, the photographic paper p is cut into a sheet and introduced into the automatic developing apparatus AP, however, a strip-shaped photographic paper p may be introduced into the automatic developing apparatus AP.

Of course, the automatic developing apparatus AP of the present invention may be constructed integrally with the photographic printer B, or alternatively the automatic developing apparatus AP of the present invention may be constructed separately from the photographic printer B. The explanation of the present invention is made under the condition that the automatic developing apparatus AP includes the color development tank 1A, bleaching and fixing tank 1B and stabilizing tanks 1C, 1D, 1E, wherein these tanks substantially compose a processing tank 1. However, it should be noted that the present invention is not limited to the specific example. The present invention can be applied to an automatic developing apparatus AF (shown in FIG. 1(B)) for processing an exposed negative photographic film f, and the automatic developing apparatus AF includes four tanks of a color developing tank, bleaching tank, fixing tank and stabilizing tank.

FIG. 2(B) is a plan view showing the structure of the automatic developing apparatus AP. As illustrated in the drawing, the color developing tank 1A, bleaching and fixing tank 1B, and stabilization tank 1E are respectively provided with dissolution tanks 2A, 2B, 2E, circulation tanks 2C, 2D, and solid processing agent replenishing devices 3A, 3B, 3E for replenishing the solid processing agent. Reference numeral 4 is a replenishing water tank for replenishing water to the color developing tank 1A and stabilization tank 1E.

Figure 3:
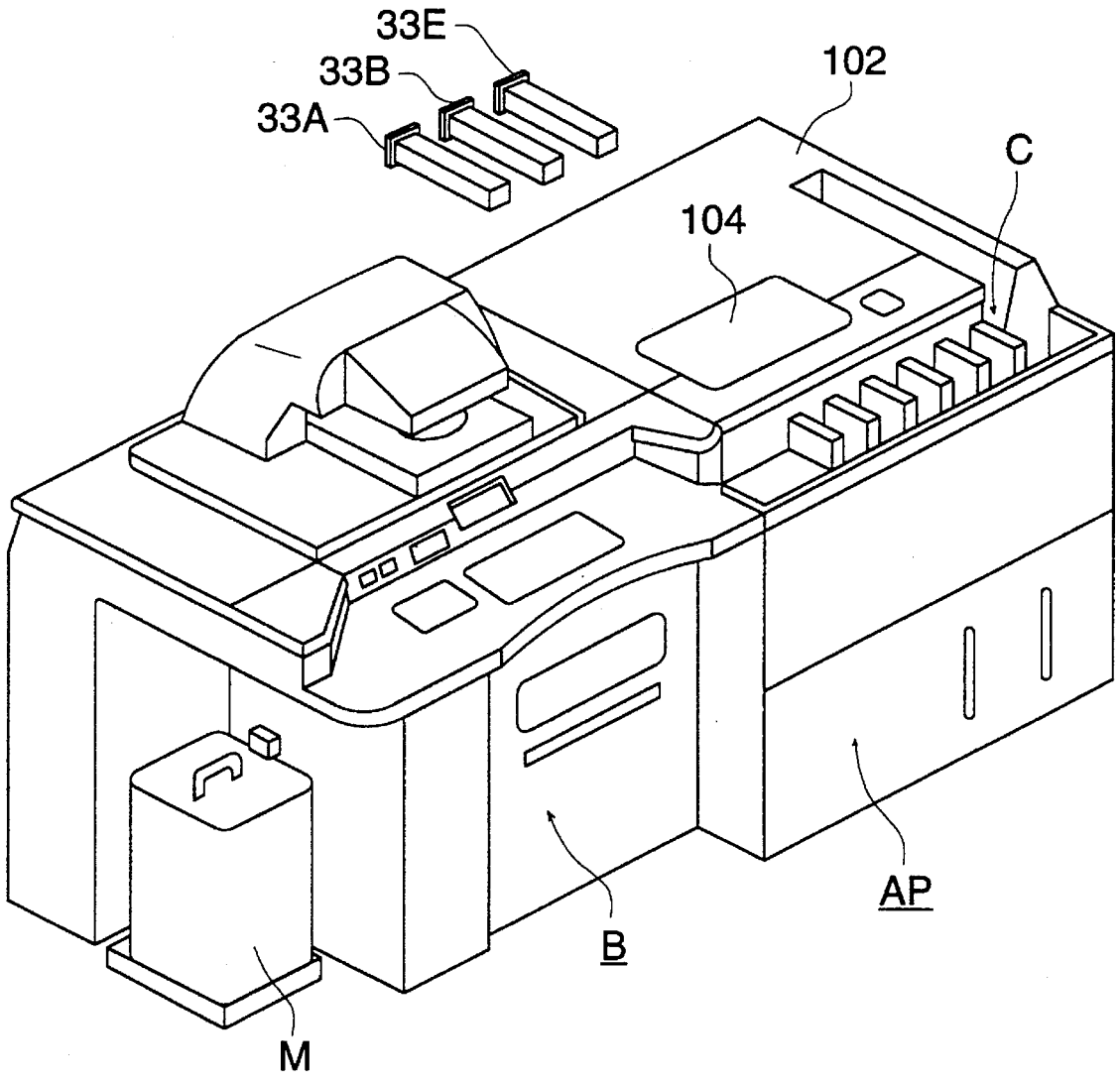
FIG. 3 is a perspective view of the processor.

FIG. 3 is a perspective view showing the entire silver halide photosensitive material processing apparatus in which the automatic developing apparatus AP of the present invention, photographic printer B and sorter C are integrally combined. In FIG. 3, the cover 104 of the automatic developing apparatus AP is opened upward, and the accommodating containers 33A, 33B, 33E having solid processing agent are inserted into each of the solid processing agent replenishing devices 3A, 3B, 3E.

Figure 2:
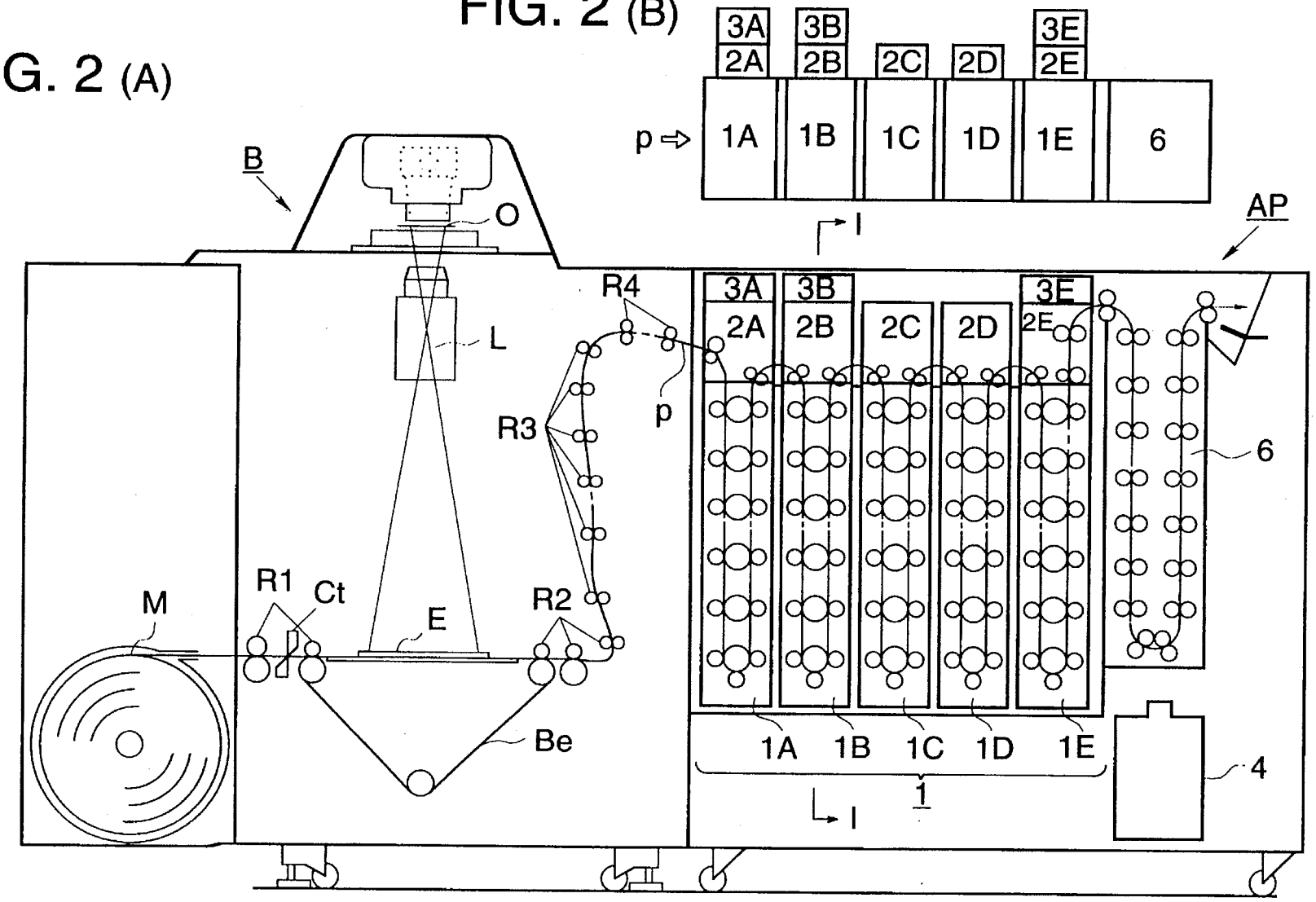
FIGS. 2(A) and 2(B) are overall arrangement views of the silver halide photosensitive material processor (printer processor) and a plan view of the automatic developing apparatus.
Figure 4:
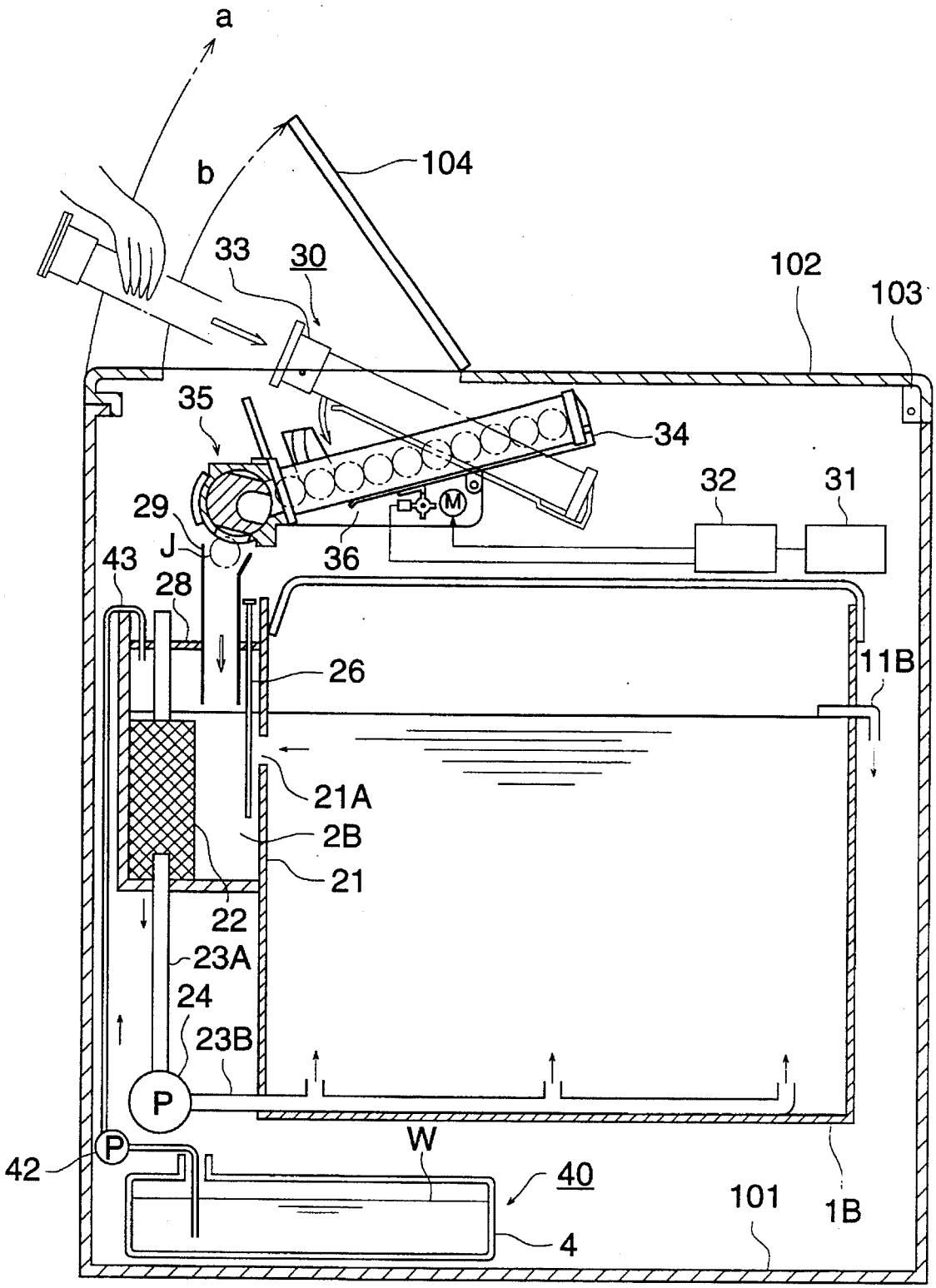
FIG. 4 is a cross sectional view of the automatic developing apparatus according to the present invention.

FIG. 4 is a cross sectional view taken on line I—I in FIG. 2 showing the automatic developing apparatus AP. In FIG. 4, there are shown cross sectional views of the bleaching and fixing tank 1B, dissolution tank 2B communicated with the bleaching and fixing tank 1B, and solid processing agent supply means 30. In this connection, for enhancing the understanding of the invention, the conveyance means for conveying the photosensitive material is omitted in the drawing. In this example, explanations will be made under the condition that tablets of solid processing agent are used.

The bleaching and fixing tank 1B for processing the photosensitive material includes a dissolution tank 2B integrally provided outside the separation wall 21 composing the bleaching and fixing tank 1B. The bleaching and fixing tank 1B and dissolution tank 2B are separated by a partition wall 21 on which a communicating hole 21A is formed so that the processing solution (bleaching and fixing solution) can be communicated through the communicating hole 21A. Numeral 29 is a guide member (guide passage composing member) which receives the solid processing agent dropped from the solid processing agent replenishing device 30 and guides it to an upper position of the dissolution tank 2B.

A cylindrical filter 22 is disposed below the dissolution tank 2B in such a manner that the cylindrical filter 22 is capable of being replaced. The cylindrical filter 22 removes paper scraps and others in the processing solution. The cylindrical filter 22 prevents the solid processing agent J that has not been dissolved from getting into the circulation pump 24 and the bleaching and fixing tank 1B. A circulation pipe 23A connected with the suction side of the circulation pump 24 (circulation means) is inserted into the filter 22 penetrating through a lower wall of the dissolution tank 2B.

The circulation system includes the circulation pipe 23A forming a circulation passage of the processing solution, and also includes the circulation pump 24. One end of the circulation pipe 23B is communicated with the delivery side of the circulation pump 24, and the other end penetrates an outer wall of the bleaching and fixing tank 1B, so that the circulation pipe 23B is communicated with the bleaching and fixing 1B. Due to the foregoing construction, when the circulation pump 24 is operated, the processing solution is sucked from the dissolution tank 2B and discharged into the bleaching and fixing tank 1B, so that the discharged processing solution is mixed with the processing solution in the bleaching and fixing tank 1B, and then sent to the dissolution tank 2B. In this way, the processing solution is circulated. The circulating direction of the processing agent is not limited to the direction shown in FIG. 4, but the direction may be reverse to that shown in FIG. 4.

A waste solution pipe lib is provided for permitting the processing solution in the bleaching and fixing tank 1B to overflow, so the solution level can be maintained constant and an increase in the amount of components conveyed from other tanks into the processing tank 1 can be prevented. Further, an increase in the amount of components oozing out from the photosensitive material can be prevented.

A rod-shaped heater 26 penetrates an upper wall of the dissolution tank 2B, and is dipped in the processing solution in the dissolution tank 2B. The processing solutions in the dissolution tank 2B and bleaching and fixing tank 1B are heated by this heater 26. In other words, the heater 26 is a temperature regulating means for regulating the temperature of the processing solution in the bleaching and fixing tank 1B, so that the temperature can be controlled in an appropriate range, for example, in a range from 20° to 55° C.

A water replenishing means 40 for replenishing water W to the dissolution tank 2B includes a replenishing water tank 4, bellows pump 42, and water supply pipe 43. An appropriate amount of replenishing water W is replenished at an appropriate time by the replenishing water supply control means 41.

The solid processing agent replenishing means 30 used for the present invention includes an accommodating container 33 for accommodating the tablet type solid processing J, a solid processing agent replenishing means 35, and a drive means 36. An upper cover 102 of the automatic developing apparatus AP is pivotally mounted on a shaft 103 of the back of the main body in which the processing tanks 1A to 1E and the dissolution tanks 2A, 2B, 2E are accommodated. When the upper cover 102 is raised in the direction of "a" illustrated in FIG. 4 and the front and upper sides of the apparatus are greatly opened, it is possible to inspect the solid processing agent replenishing means 30 and replace the filter 22.

A cover 104 is pivotally mounted on an upper portion of the upper cover 102 described before. When the cover 104 is opened in the direction of chain line "b" in the drawing, the solid processing agent J is replenished into the accommodating container 33.

Figure 5:
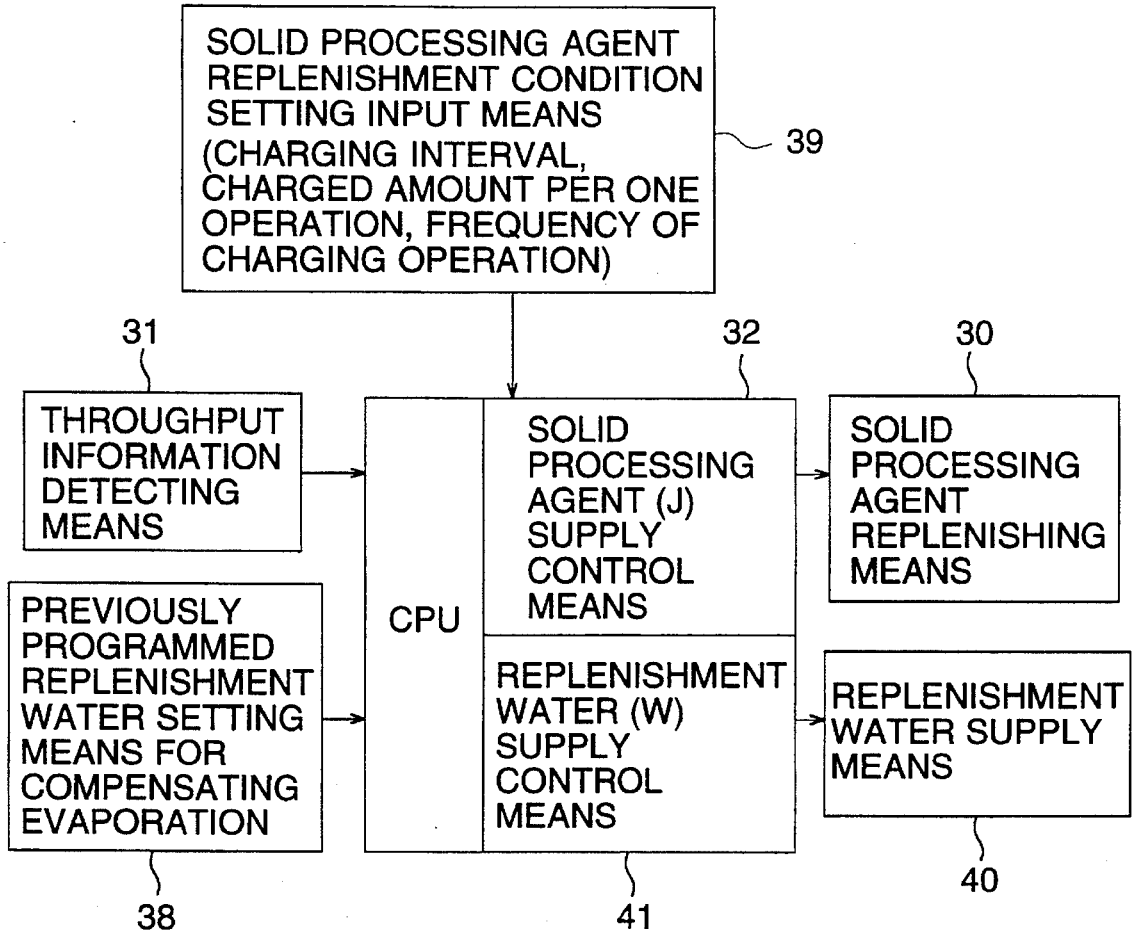
FIG. 5 is a block diagram for controlling the supply of the solid processing agent and replenishing water.

FIG. 5 is a block diagram for controlling the supply of solid processing agent J and replenishing water W.

A throughput information detecting means 31 is disposed at an entrance of the automatic developing apparatus AP, and detects the throughput of the photosensitive material to be processed. This throughput information detecting means 31 is comprised of a plurality of detecting members that are disposed in a transverse direction. This throughput information detecting means 31 detects the width of photosensitive material, and the result of detection is used for counting the detection time. Since the conveyance speed of photosensitive material is previously set in a mechanical manner, the throughput of photosensitive material, that is, the area of processed photosensitive material can be calculated form the width and time information. An infrared ray sensor, microswitch and ultrasonic sensor capable of detecting the width and conveyance time of photosensitive material can be used for this throughput information detecting means 31. A means for indirectly detecting the area of processed photosensitive material may be used for this throughput information detecting means 31. For example, in the case of the printer processor shown in FIG. 2, a means for detecting an amount of printed photosensitive material may be adopted, or alternatively, a means for detecting an amount of processed photosensitive material, the area of which is predetermined, may be adopted. Concerning the detecting time, in this example, detection is carried out before processing, however, detection may be carried out after processing or while the photosensitive material is being dipped in the processing solution. In these cases, the throughput information detecting means 31 may be disposed at an appropriate position so that detection can be conducted after processing or while the photosensitive material is being processed. It is not necessary to provide the throughput information detecting means 31 for each processing tank 1A, 1B, 1C, 1D, 1E, and it is preferable that one throughput information detecting means 31 is provided for one automatic developing apparatus AP. Reference numeral 32 is a throughput supply control means for controlling the supply of processing solution in accordance with a signal sent from the throughput information detecting means 31. Numeral 41 is a replenishing water amount control means for controlling an amount of supply of replenishing water. Numeral 38 is a setting means for replenishing water in accordance with an amount of evaporation of the processing solution, wherein the setting means is previously programmed. Numeral 39 is a solid processing agent replenishing condition setting input means.

Figure 6:
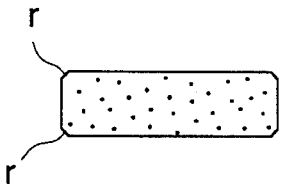
FIGS. 6(A) through 6(E) are cross sectional and perspective views showing various configurations of the tablet type of solid processing agent.
Figure 6:
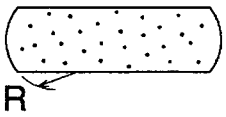
Figure 6:
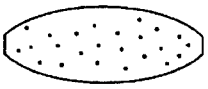
Figure 6:
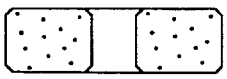
Figure 6:
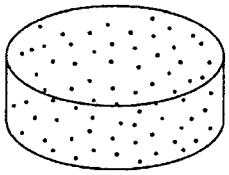

FIG. 6 shows various configurations of the tablet type solid processing agent J. FIG. 6(A) is a sectional view of the cylindrical flat tablet type solid processing agent J, wherein the configuration is circular and the corners are chamfered by the radius of curvature of r. FIG. 6(E) is a perspective view of the tablet type solid processing agent J. FIG. 6(B) is a sectional view of the flat tablet type solid processing agent J, wherein the configuration is circular, and the upper and lower surfaces are flat, and the circumferential surface is formed convex by the radius of curvature of R. FIG. 6(C) is a sectional view of the tablet type solid processing agent J, wherein the configuration is flat, and the upper and lower surfaces are formed spherical. FIG. 6(D) is a sectional view of the tablet type solid processing agent J, wherein the configuration is a doughnut-shape having a hole at the center.

Figure 7:
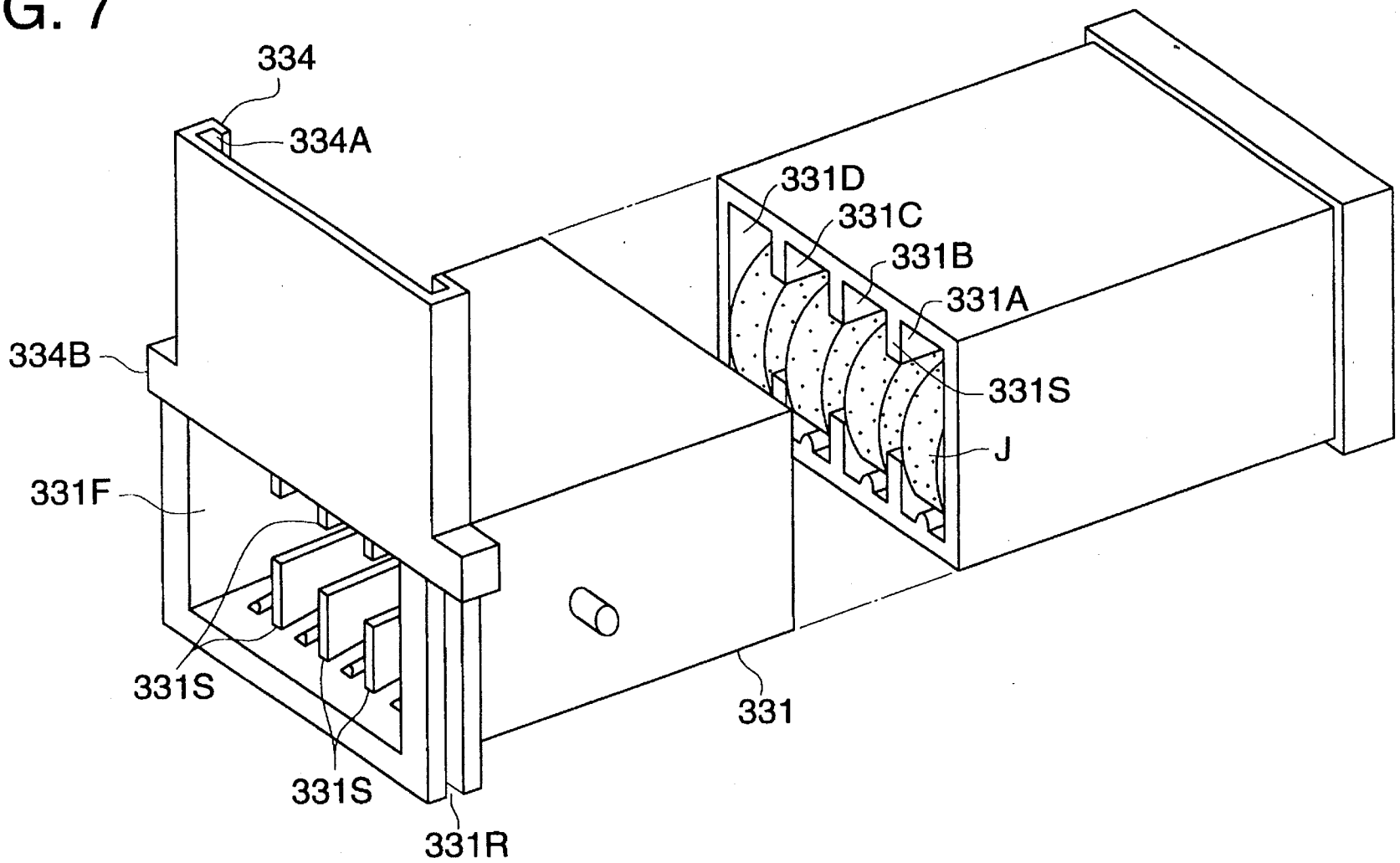
FIG. 7 is a partially exploded perspective view of the accommodating container for accommodating a tablet type of solid processing agent.

FIG. 7 is a view showing the accommodating container (cartridge) 33 for accommodating the tablet type solid processing agent J according to the present invention. FIG. 7 is a partially exploded perspective view of the accommodating container 33.

The accommodating container 33 includes: a container main body 331, the configuration of which is like a hollow square hole, the container main body 331 having a discharge opening 331F through which the tablet of solid processing agent can be discharged; a cap member 333 for closing the other opening 331G of the container main body 331; and a sliding cover 334 capable of being moved upward and downward, wherein the sliding cover 334 slides on a rail 331R of the container main body 331.

Three sets of partition walls 331S are integrally fixed inside the container 331, so that the inside of the container 331 is divided into four chambers 331A, 331B, 331C, 331D. In each chamber, the approximately cylindrical tablets of solid processing agent J are longitudinally accommodated under the condition that each outer circumference is externally contacted with the inside wall of the chamber. Specifically, 10 tablets of solid processing agent J are accommodated in the each chamber.

The rail portion 331 provided on both outsides of the discharge opening 331F is slidably engaged with the groove portion 334A provided on both sides of the opening and closing cover 334. Protrusions 334B formed at both lower ends of the opening and closing cover 334 are engaged with the opening and closing regulating member so that the sliding cover 334 can be automatically opened and closed.

The accommodating container 33 is made of resin or cardboard subjected to moisture-proof processing.

Examples of usable resins to make the accommodating container 33 are: polyethylene (made by either the high pressure method or the low pressure method, polypropylene (stretched or unstretched), polyvinyl chloride, polyvinyl acetate, nylon (stretched or unstretched), polyvinylidene chloride, polystyrene, polycarbonate, vinylon, polyethylene terephthalate (PET), other polyesters, acrylonitrile copolymer, and resin of epoxy-phosphoric acid.

Figure 8:
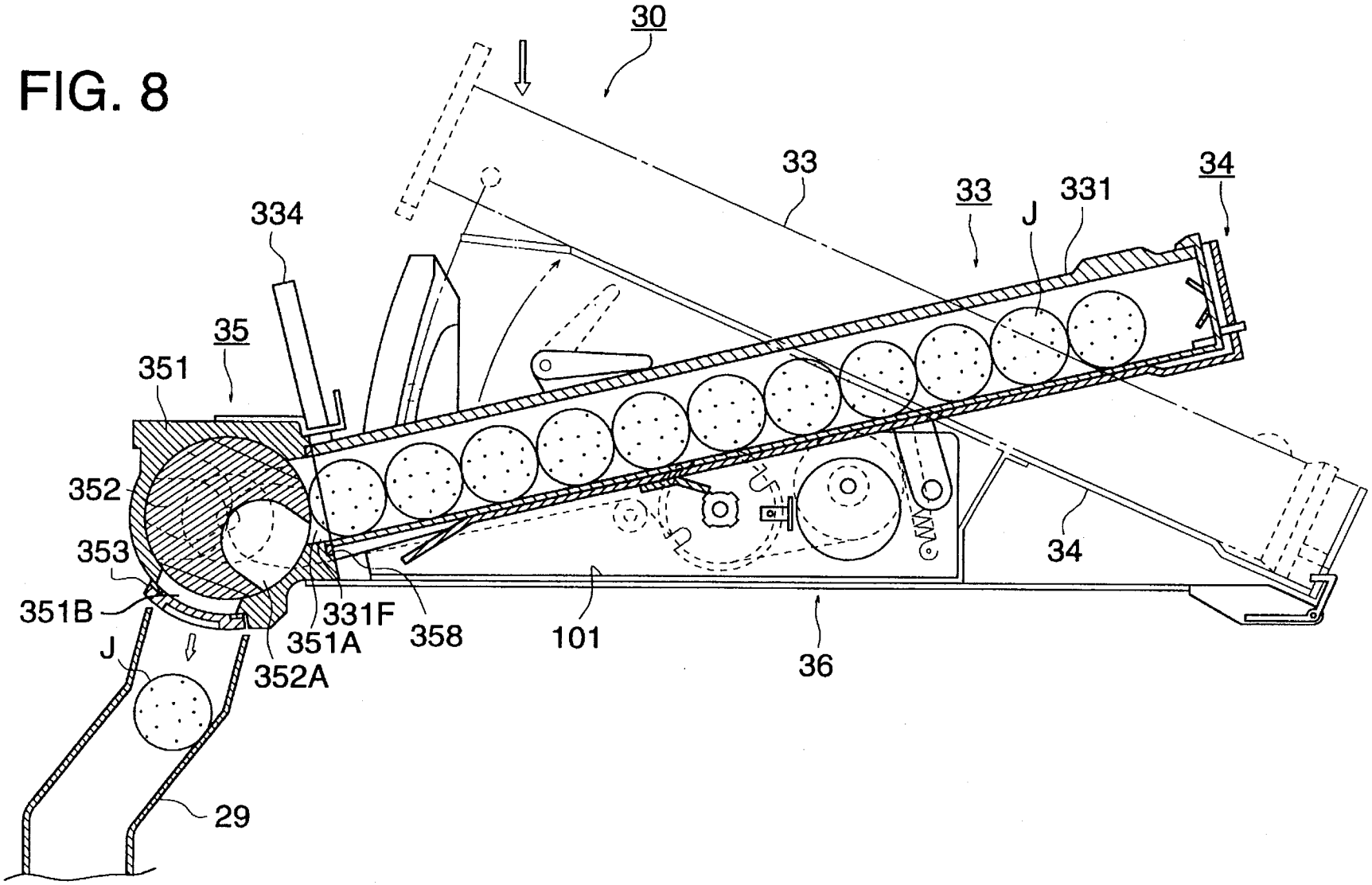
FIG. 8 is a cross sectional view of the solid processing agent replenishing device.

FIG. 8 is a sectional side view of the solid processing agent replenishing device 30 including the accommodating container 33, accommodating container charging means 34, solid processing agent replenishing means 35 and drive means 36.

When the accommodating container 33 is attached at a predetermined position of the accommodating container charging means 34, the opening and closing cover 334 is opened and the discharge opening 331F is opened, so that the accommodating container 33 is communicated with the inlet portion 351A of the solid processing agent replenishing means 35.

The solid processing agent replenishing means 35 is disposed in the housing member 351 in such a manner that the solid processing agent replenishing means 35 can be rotated on an inner circumferential surface of the housing member 351. The solid processing agent replenishing means 35 includes a rotatable solid processing agent conveying member (rotor) 352, and a shutter section 353 for opening and closing the outlet portion 351B, wherein the solid processing agent conveying member (rotor) 352 has a pocket portion 352A by which a predetermined amount of solid processing agent J is received from the inlet portion 351A and moved to the outlet portion 351B.

A frame-shaped resilient packing 358 is embedded in the periphery of the opening on the end surface of the inlet portion 351A of the housing member 351. When the discharge opening 331F of the accommodating container 33 is closely contacted with the inlet portion 351A, the outside air can be shut off by the frame-shaped resilient packing 358, so that moisture-proofing effect can be enhanced.

When all solid processing agent tablets J in the accommodating container 33 have been successively consumed, a remainder detection signal is generated, and the accommodating container 33 is replaced in accordance with the signal.

The rotor 352 is provided with 4 pockets 352A. Each pocket can accommodate one solid processing agent. The phase of each pocket 352A is shifted. Therefore, when the rotor 352 is rotated by one revolution, the solid processing agent J is charged into the first pocket 352A from the discharge opening of the accommodating container 33. Then the solid processing agent tablets are successively charged into the second, third and fourth pockets. In the same manner, the solid processing agent tablets are successively discharged out from the outlet portion 351B.

Figure 9:
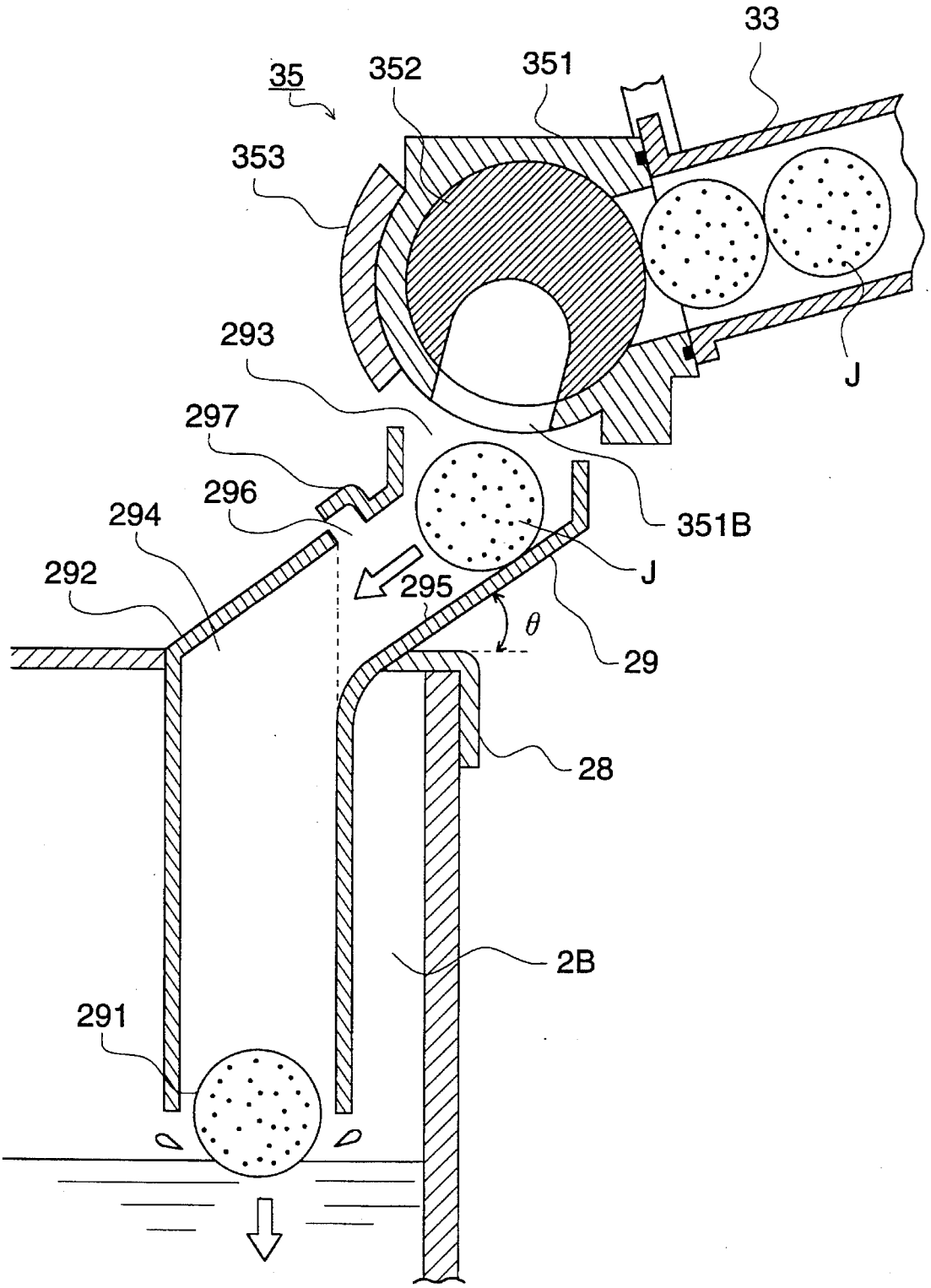
FIG. 9 is a partially sectional view of the replenishing device for replenishing the tablet type of solid processing agent.

FIG. 9 is a cross sectional view showing the detail of the solid processing agent replenishing means 35 and guide member 29.

The aforementioned guide member 29 is arranged under the outlet 351B of the housing member 351 of the solid processing agent replenishing means 35. The guide member 29 receives the solid processing agent J sent from the accommodating container 33 through the rotor 352. In this case, the solid processing agent J is discharged into the guide member 29 from the outlet opening 351B when the shutter member 353 is opened. After the solid processing agent J has been received by the guide member 29, it is guided to an upper position above the processing solution surface of each dissolution tank (2A, 2B, 2E) and dropped into the solution.

An upper space on the processing solution in the dissolution tank 2B is substantially shielded by the canopy member 28 and the guide member 29. A portion vertically projected upward from the lower region enclosed by the outlet opening portion 291 of the solid processing agent supply passage of the guide member 29 is completely covered with the inclined wall 292 as shown in FIG. 9. The solid processing agent replenishing passage is formed so that the portion vertically projected upward from the lower region enclosed by the outlet opening portion 291 can not overlap with a portion vertically projected downward from the upper region enclosed by the inlet opening portion 293 of the solid processing agent replenishing passage.

A curved inclined pipe 294 having an inclined wall 292 connects the inlet opening 293 of the solid processing agent replenishing passage with the outlet opening 291. The curved inclined pipe 294 is provided with a bottom wall 295 inclined by the angle θ. Therefore, the solid processing agent J which has been discharged from the outlet 351 and dropped by its own weight is received by the bottom wall 295, so that the dropping speed of the solid processing agent is reduced. When the solid processing agent is guided by the bottom wall 295, the speed is regulated by the action of the inclination angle θ, so that the solid processing agent J is dropped gently. Accordingly, the splash of the processing solution is extremely reduced. The inclination angle θ is determined to be 30° to 70° in accordance with the dropping speed of the solid processing agent, the route from the outlet opening 351B to the processing solution surface, the length of the inclined pipe 294, and the configuration of the dissolution tank 2B. In the case of a granular, powdery or pill-shaped solid processing agent, it is preferable that the inclination angle of the charging guide member is 45° to 80°. However, in a replenishing system in which the solid processing agent is washed away together with replenishing water, the inclination angle may be smaller than that. An inclined wall 292 on the upper side of the solid processing agent supply passage of the guide member 29 is approximately parallel with the bottom wall 295, and the inclination angle is approximately θ.

A ventilation hole 296 is formed in a portion of the inclined wall 292. Highly humid vapor rising from the solution surface in the dissolution tank 2B is let out from the ventilation hole 296.

Since the guide member 29 of the present invention is composed in the above manner, the dropping speed of the solid processing agent J is reduced, so that the solid processing agent J is dropped onto the processing solution surface at a slow speed. Accordingly, the splash of the solution is reduced, and further the splash is blocked by the curved inclined pipe 294, so that the splashed solution is not deposited on the bottom wall 295 on which the solid processing agent J slides and the outlet 351B of the solid processing agent replenishing means 35.

A position of the outlet opening 291 of the guide member 29 is shifted from a position of the inlet opening portion 293 with regard to the vertical direction so that the position of the outlet opening 291 and the position of the inlet opening portion 293 are not overlapped to each other. Accordingly, even when vapor of high temperature rises from the processing solution surface in the dissolution tank 2B to the outlet opening 291, it is blocked by the inclined wall 292 arranged at a perpendicularly upper position, and vapor is condensed here. Accordingly, the rising vapor does not arrive at the inlet opening 293 and the outlet 351B of the solid processing agent replenishing means 35 located close to the inlet opening 293. Dew condensed on the inclined wall 292 drops along the inclined wall 292 and drips from the outlet opening 291. Drips from the outlet opening 291 are accommodated in the dissolution 2B.

It is possible to let off the rising vapor from the ventilating hole 296 provided on the inclined wall 292. Accordingly, dew condensation on the inclined wall 292 can be reduced. In this connection, numeral 297 is a protective cover (fin) by which an upper portion of the ventilating hole 296 is covered. Therefore, dust, foreign objects and powder of the solid processing agent to be replenished to other processing solution tanks are prevented by the protective cover 297 from getting into the solid processing agent replenishing passage.

The inventors made an experiment in which the automatic developing apparatus was left for one week under an operational condition. As a result of the experiment, the following were found. When the ventilating hole 296 was formed, the preserving property of the solid processing agent J in the solid processing agent accommodating container 33 was improved. At the same time, the expansion of the solid processing agent J was reduced so that the occurrence of defective charging was avoided. Further, discoloration of the solid processing agent was prevented and the photographic performance was maintained high.

In this example, the canopy member 28 covers an upper portion of the processing solution surface of the dissolution tank 2B. However, even to an open type apparatus having no canopy member 28, the present invention can be applied.

Figure 10:
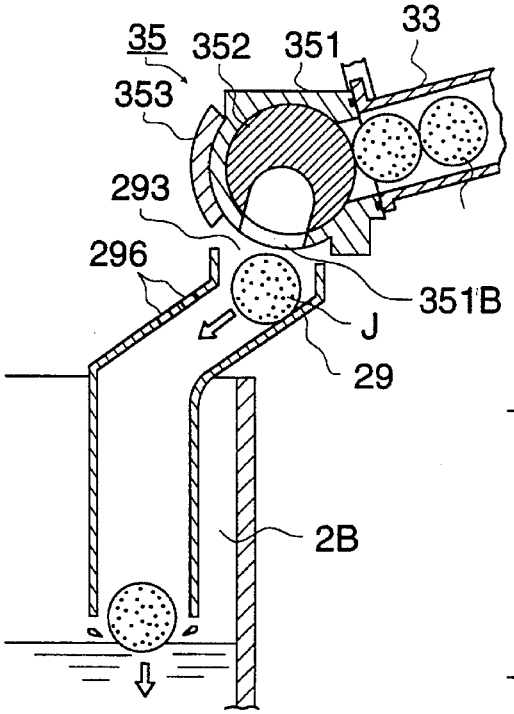
FIGS. 10(A) and 10(B) are cross sectional views of the guide member and solid processing agent replenishing means of the present invention.
FIG. 10(C) is a perspective view.
Figure 10:
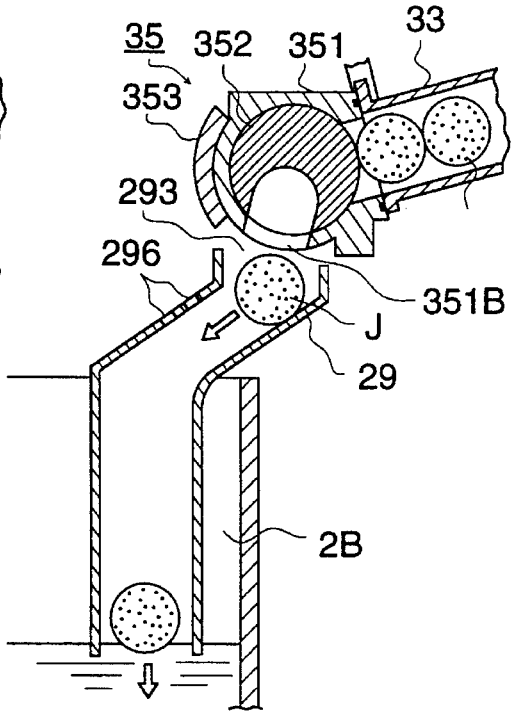
Figure 10:
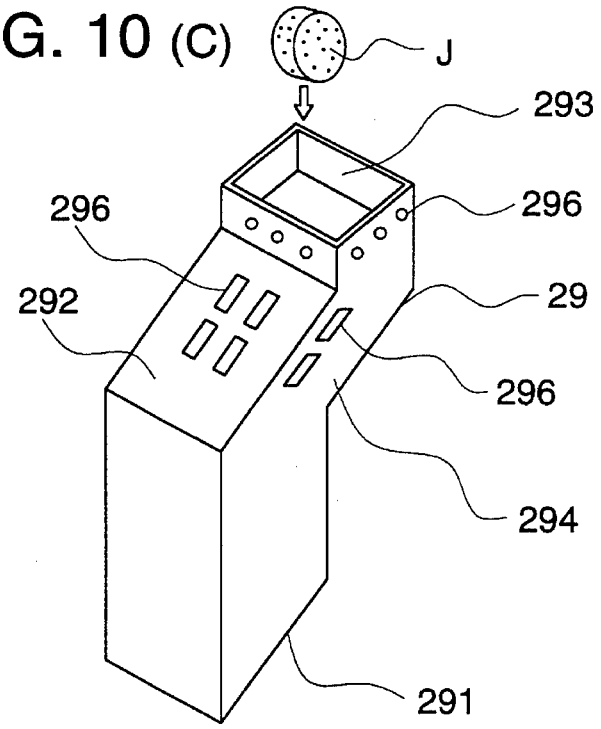

FIGS. 10(A) and 10(B) are cross sectional views showing the guide member 29 and solid processing agent replenishing means 35 of another example of the present invention. FIG. 10(C) is a perspective view of the guide member 29. In this connection, FIG. 10(A) is a view of the apparatus in which the outlet opening of the guide member 29 is separate from the processing solution surface, and FIG. 10(B) is a view of the apparatus in which the outlet opening of the guide member 29 is submerged in the processing solution.

In these drawings, a plurality of ventilating holes 296 are formed on the upper inclined wall 292 of the guide member 29. Alternatively, the ventilating holes 296 may be formed in an upper portion on the side of the inclined pipe 294. Alternatively, the ventilating holes 296 may be formed on a side wall close to the inlet opening 293 in an upper portion of the guide member 29.

Figure 11:
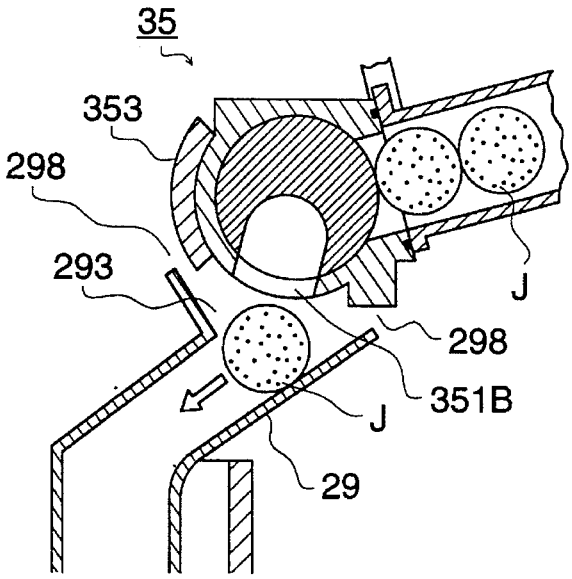
FIGS. 11(A) to 11(C) are cross sectional views showing a clearance between the solid processing agent replenishing means and the guide member.
Figure 11:
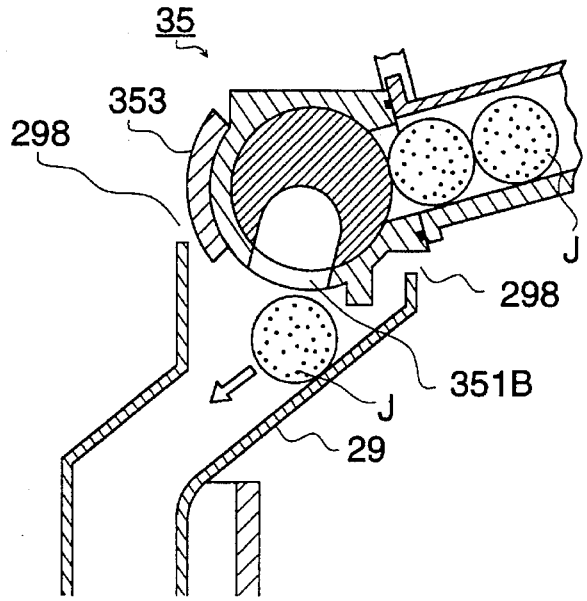
Figure 11:
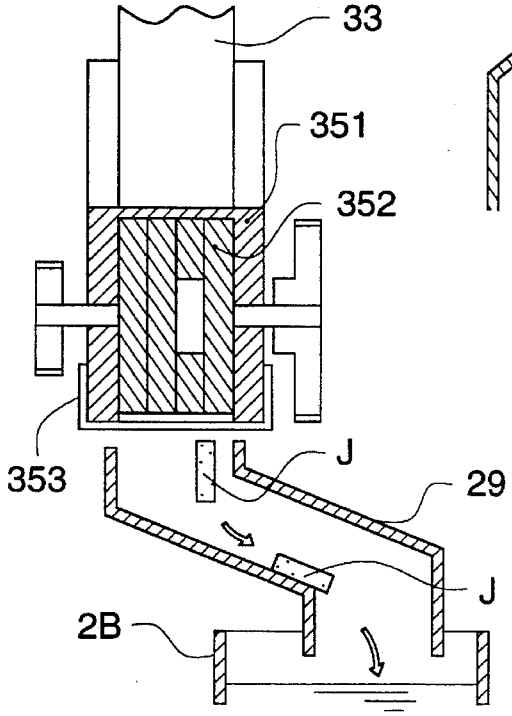

A clearance portion (ventilating holes) 298 may be in a portion close to the outlet portion 351B of the solid processing agent replenishing means 35 and the inlet opening portion 293 of the guide member 29, and vapor may be let off from this clearance. FIG. 11 sows various examples of the clearance portion of the guide member 29.

FIG. 11(A) is a view showing an example in which an inlet opening 293 of the guide member 29 is formed into a trumpet-shape and a clearance 298 is provided between the solid processing agent replenishing means 35 and the inlet opening 293 of the guide member 29. FIG. 11(B) is a view showing an example in which the inlet opening portion 293 of the guide mender 29 is further extended so that the inlet opening portion 293 can cover a lower portion of the solid processing agent replenishing means 35, and the clearance portion 298 is provided between the solid processing agent replenishing means 35 and the inlet opening 293 of the guide member 29. FIG. 11(C) is a view showing an example in which a guiding direction of the guide member 29 is changed to be a right angle. Since the direction of the guide member 29 is substantially parallel with the conveyance direction of photosensitive material P in the processing tank, the inclination angle and height of the guide member 29 can be freely determined while a space above the processing solution tank is maintained to be compact. When solid processing agent J is discharged from the replenishing device 30, it slides on the inclined surface of the guide member 29 while the conveyance direction is curved as illustrated in FIG. 11(C). Therefore, the dropping speed of the solid processing agent is reduced, and the splash of the solution is reduced.

Figure 12:
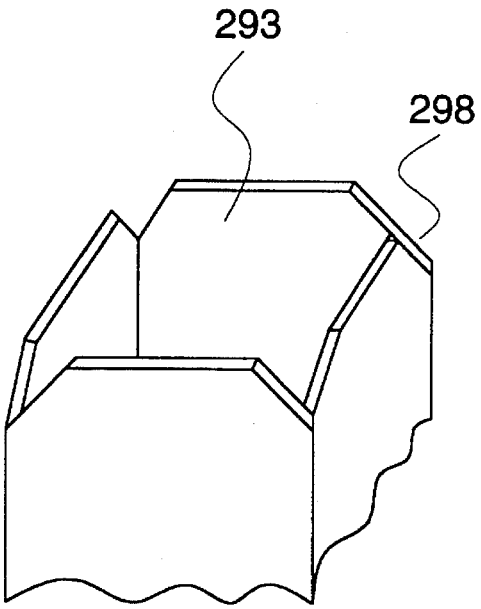
FIGS. 12(A) to 12(D) are perspective views showing examples of various configurations of the inlet opening portion of the guide member.
Figure 12:
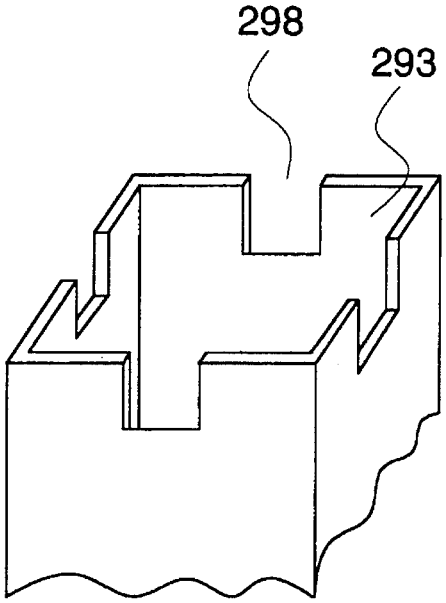
Figure 12:
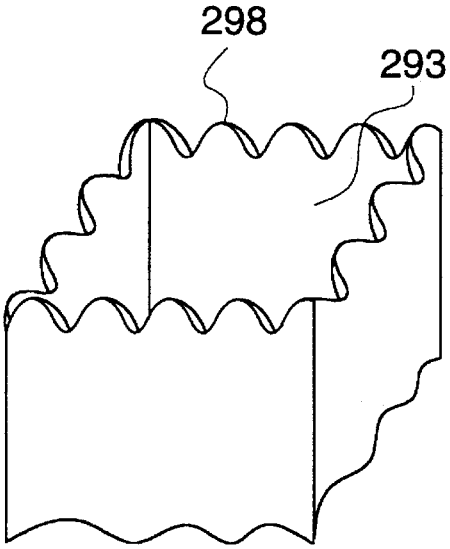
Figure 12:
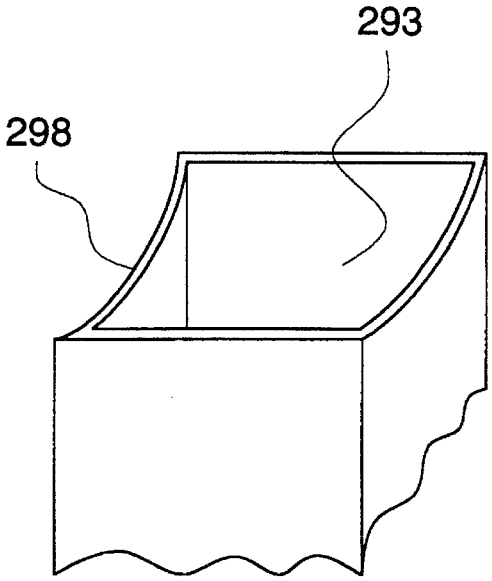

FIGS. 12(A) to 12(D) are perspective views showing various configurations of the inlet opening portion 293 of the guide member 29. In FIG. 12(A) a V-shaped notched portion is formed at each corner of the inlet opening portion 293 so as to form a clearance portion 298. In FIG. 12(B), a portion of each side of the inlet opening portion 293 is notched so that a clearance portion 298 is formed. In FIG. 12(C), the inlet opening portion 293 is formed to be corrugated so as to form a clearance portion 298. In FIG. 12(D), an arcuate clearance portion 298 is formed in accordance with the locus of the shutter member 353.

Figure 13:
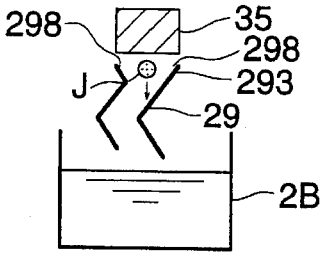
FIGS. 13(A) to 13(D) are schematic illustrations showing models of various configurations of the guide member and the ventilating portion dissolution tank.
Figure 13:
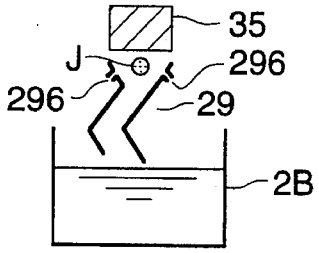
Figure 13:
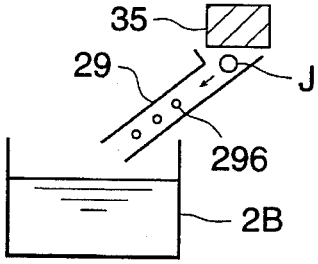
Figure 13:
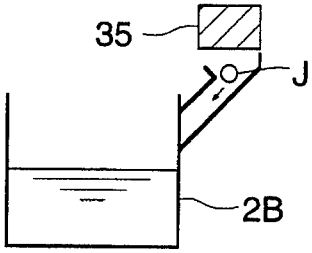

FIGS. 13(A) to 13(D) are schematic illustrations showing various configurations of the guide member 29 and the ventilating portion. In FIG. 13(A), solid processing agent J is dropped substantially vertically in the guide member 29, and the clearance portion 298 is provided in an upper portion of the inlet opening portion 293. In FIG. 13(B), a ventilating hole 296 is provided on the inclined surface of the inlet opening portion 293. In FIG. 13(C), the guide member 29 is inclined, and ventilating holes are provided on the side of the guide member 29. In FIG. 13(D), the outlet opening of guide member 29 is provided on the side wall of the dissolution tank 2B. In this connection, in the apparatus illustrated in FIGS. 13(A) to 13(D), the canopy member 28 may be provided in an upper portion of the dissolution tank 2B and the canopy member 28 may be maintained in a closed condition.

Figure 14:
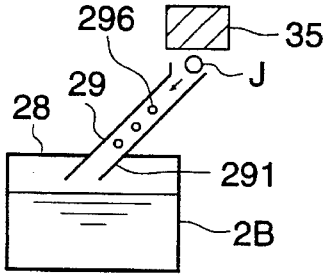
FIGS. 14(A) to 14(D) are schematic illustrations showing a model of the guide member of another example.
Figure 14:
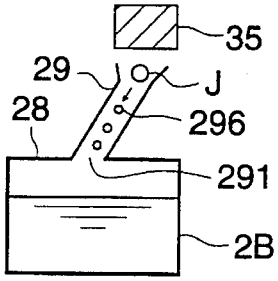
Figure 14:
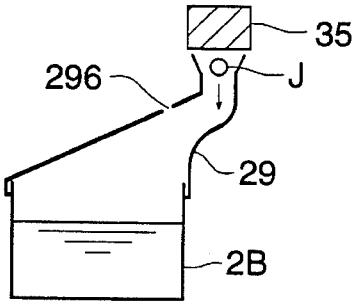
Figure 14:
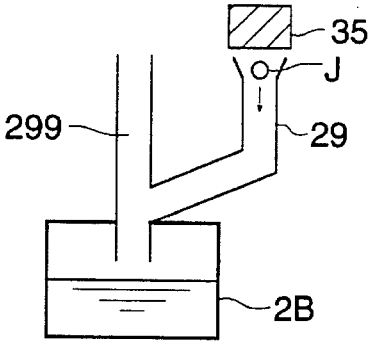

FIGS. 14(A) to 14(D) are schematic illustrations showing various examples of the guide member 29 in which an upper portion of the dissolution tank 2B substantially airtightly closed. In FIG. 14(A), an outlet opening portion 291 of the inclined guide member 29 is arranged close to the processing solution surface. In FIG. 14(B), an outlet opening portion 291 of the guide member 29 is arranged close to a ceiling portion of the canopy member 28. In FIG. 14(C), the guide member 29 and the canopy member 28 are integrally formed into one unit. In FIG. 14(D), there is provided a ventilating pipe (ventilating section) 299 branching off from the guide member 29.

FIGS. 15(A) to 15(E) are schematic illustrations of examples of various configurations of guide member 29 and ventilating portion. In the examples shown in the drawings, the dropping speed of solid processing agent J dropped from the inlet opening 293 is reduced by the means for dropping speed provided in the guide member 29. Therefore, solid processing agent J is gently dropped into the processing solution and the occurrence of splash can be prevented.

Figure 15:
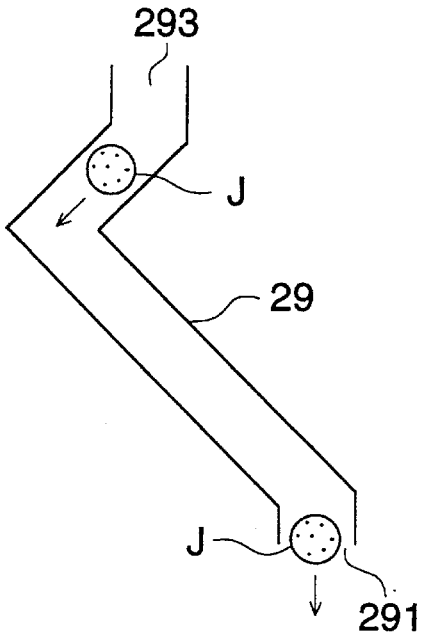
FIGS. 15(A) to 15(E) are schematic illustrations showing a model of the guide member of still another example.
Figure 15:
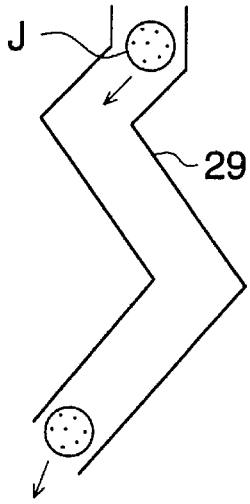
Figure 15:
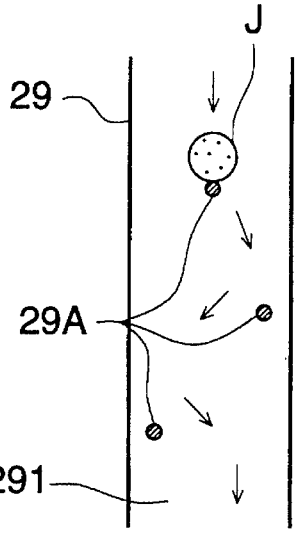
Figure 15:
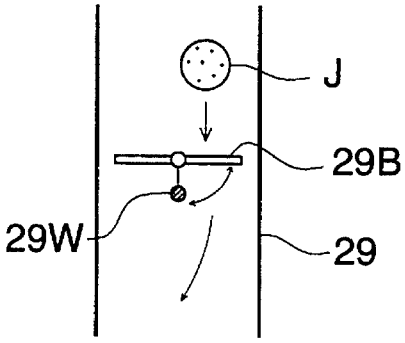
Figure 15:
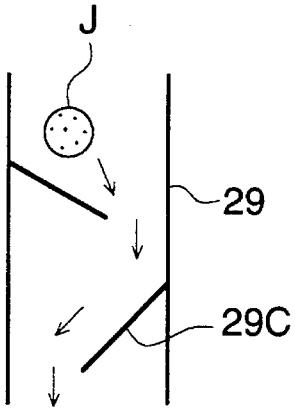

In FIG. 15(A), a V-shaped introducing portion 29 is shown. In FIG. 15(B), an N-shaped introducing portion 29 is shown. When the solid processing agent is dropped onto the inclined wall of the guide member 29, it slides zigzag on the wall, so that the speed is reduced. In FIG. 15(C), a plurality of fixed pins 29A are arranged inside the guide member 29. When solid processing agent J is dropped into the guide member 29, it collides with the fixed pins 29A, so that the advance direction is changed and the speed is reduced. Finally solid processing agent J is discharged from the outlet opening portion 291. In FIG. 15(D), a rotatable impeller 29B is provided in the passage of the guide member 29. When solid processing agent J is dropped into the guide member 29, it collides with the impeller 29B, so that the impeller 29B is rotated and the passage is open. Therefore, solid processing agent J drops downward. Numeral 29*w* is a weight attached at a lower position of the rotary shaft of the impeller 29B. By the action of the weight 29*w*, the impeller 29B is returned to the closing position after solid processing agent J has passed through the guide member 29. In FIG. 15(E), a plurality of inclined plates 29C are arranged in the guide member 29. In this case, the plurality of inclined plates 29C may be arranged in either a fixed or oscillated condition. When solid processing agent J is dropped, it collides with the inclined plates 29C so that the dropping direction is changed and the dropping speed is reduced. By the inclined plates 29C, the splash of the processing solution can be prevented when solid processing agent J has dropped on the solution surface.

Figure 16:
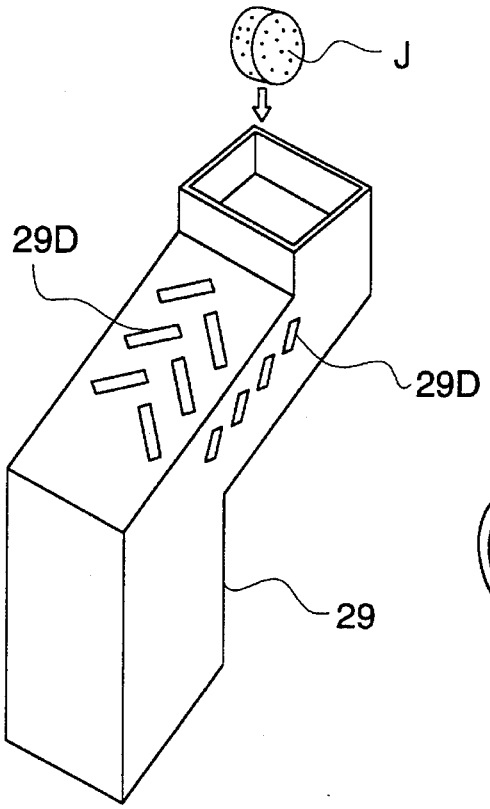
FIGS. 16(A) to 16(C) are schematic illustrations showing a model of the guide member of still another example.
Figure 16:
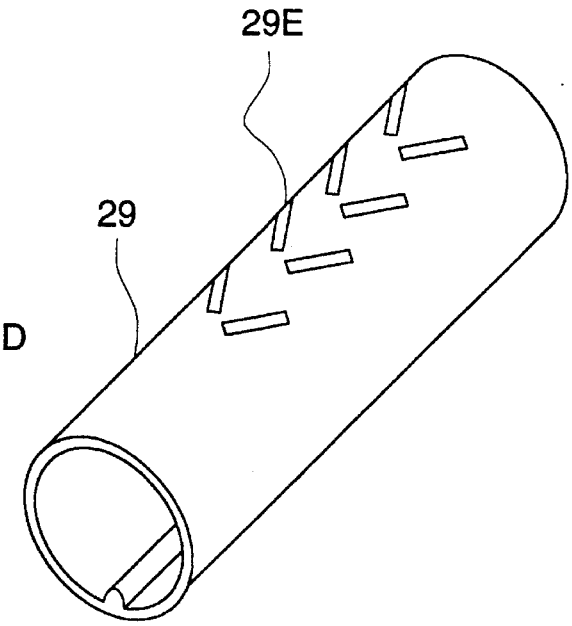
Figure 16:
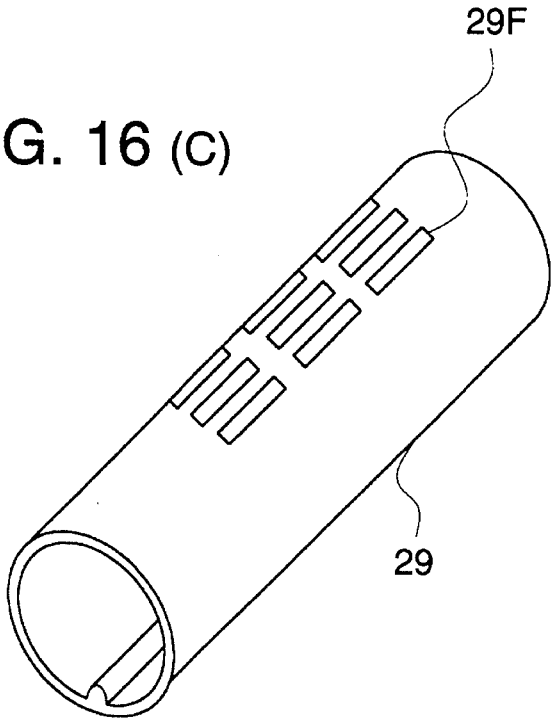
Figure 17:
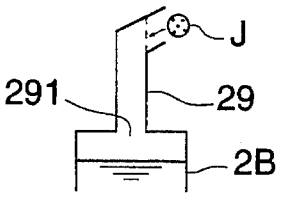
FIGS. 17(A) to 17(I) are schematic illustrations showing a model of the guide member of still another example.
Figure 17:
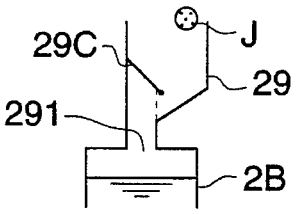
Figure 17:
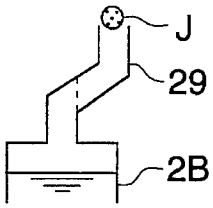
Figure 17:
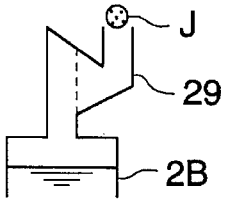
Figure 17:
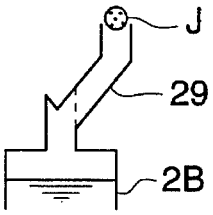
Figure 17:
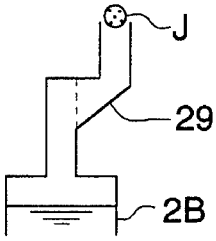
Figure 17:
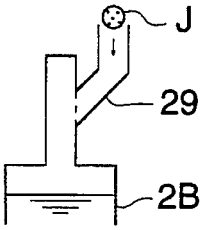
Figure 17:
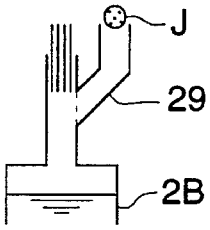
Figure 17:
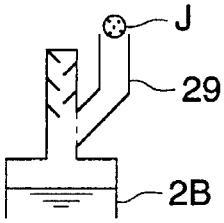

FIGS. 16(A) to 16(C) are perspective views sowing various examples of the ventilating portion. Vapor is let off to the outside of the guide member 29 through the ventilating portion. Therefore, condensation of water is prevented, so that water drops are not deposited on a ceiling portion of the guide member, and solid processing agent J can be maintained dry while it drops in the guide member 29. In FIG. 16(A), a plurality of groove-shaped ventilating holes 29D are provided on the inclined wall or side wall. In FIG. 16(B), a plurality of groove-shaped ventilating holes 29E are provided on an upper surface of the cylindrical hollow guide member 29, and drops of water deposited close to the ventilating holes 29E are made to flow downward on an upper surface of the cylindrical member. In FIG. 16(C), the plurality of ventilating holes are arranged in parallel with each other.

FIG. 17(A) to 17(I) are schematic illustrations showing various configurations of the guide member 29. In FIGS. 17(A) to 17(I), an upper space above the processing solution surface in the dissolution tank 2B is substantially shielded by the canopy member 28 of the dissolution tank 2B and the guide member 29. Further, a perpendicularly upper portion of the outlet opening 291 of the guide member 29 is completely covered with a component of the guide member 29. In these drawings, broken lines represent perpendicularly upper portions of the outlet opening portions 291.

Figure 18:
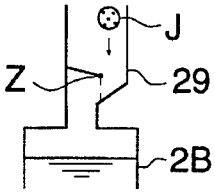
FIGS. 18(A) to 18(D) are schematic illustrations showing a model of the guide member of still another example.
Figure 18:
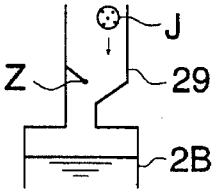
Figure 18:
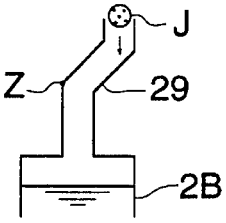
Figure 18:
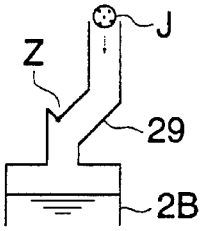

The guide member 29 of the present invention is preferably composed in the following manner. The lowermost portion of the member composing the ceiling of the solid processing agent supply passage is arranged at a position perpendicularly above the outlet opening portion 291 of the supply passage. Due to the foregoing structure, even when dew condensation occurs on a member composing the ceiling, drops of water do not drip on the lower inclined surface with which solid processing agent J comes into contact. Therefore, the drops of water return to the processing solution without affecting solid processing agent J. From this viewpoint, the structures illustrated in FIGS. 17(A), 17(C), 17(E), 17(G), 17(H) are 17(I) more preferable than those illustrated in FIGS. 17(B), (D) and (F). Points Z of the guide member 29 illustrated in FIGS. 18(A) to 18(D) represent the lowermost positions described above. The most preferable examples are shown in FIGS. 18(C) and 18(D).

Figure 19:
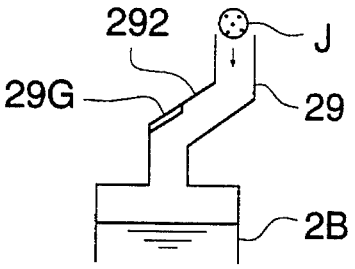
FIGS. 19(A) to 19(D) are schematic illustrations showing a model of the guide member of still another example and a perspective view of the protruding member.
Figure 19:
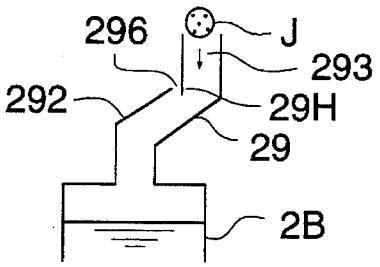
Figure 19:
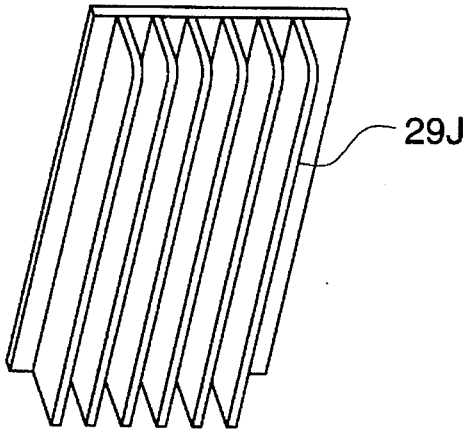
Figure 19:
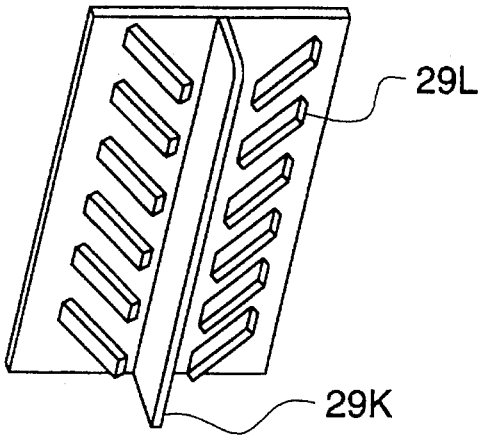

A protrusion (protruding member) 29G is provided on the ceiling surface of the solid processing agent supply passage in the guide member 29. As illustrated in FIG. 19(A), a plurality of protrusions 29G are provided on the inclined wall 292 in the guide member 29. Due to the foregoing structure, a highly humid vapor rising from the processing solution surface is subjected to dew condensation at the plurality of protrusions 29G, and drops of water drip from the protrusions 29G. In FIG. 19(B), there is provided a protruding member 29H in an upper position of the inclined wall 292, so that a highly humid vapor rising from the lower processing solution surface is prevented from getting into the inlet opening 293. When the ventilating hole 296 is arranged close to the protruding member 29H, the highly humid vapor is effectively let out through the ventilating hole 296.

FIGS. 19(C) and 19(D) are perspective views showing another example of the protruding member 29G attached onto the inner wall of the inclined wall 292. In FIG. 19(C), there are provided a plurality of fin-shaped protruding members 29J which are longitudinally arranged in parallel with each other. The protruding members 29J are protruded from the inside of the inclined wall 292. A highly humid vapor evaporating from the processing solution surface collides with the surfaces of the protruding members 29J, and dew condensation occurs and drops of water are formed. The drops of water flow on the surfaces of the inclined protruding members 29J and drop onto the processing solution surface. FIG. 19(D) is a view showing a variation of the fin-shaped protruding member. The fin-shaped protruding member includes one protruding member 29K arranged at the center, and a plurality of inclined protruding members 29L arranged on both sides of the protruding member 29K. When the highly humid vapor collides with these protruding members 29K, 29L, dew condensation occurs, and drops of water flow on the protruding members 29L and are collected to the central protruding member 29K. Then the drops of water flow downward and return to the dissolution tank 2B from the lowermost portion of the central protruding member 29K.

The protruding members or the ceiling may be made of metal, the heat radiating property of which is high, for example, the protruding members or the ceiling may be made of aluminum alloy, stainless steel or copper.

Figure 20:
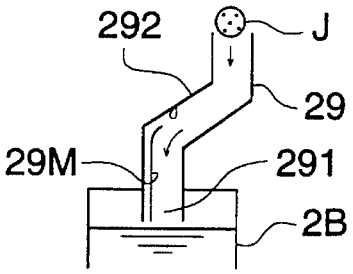
FIG. 20 is a schematic illustration showing a model of the guide member of still another example.

FIG. 20 is a schematic illustration of another example of the guide member 29. The structure of this example is described as follows. A water conveyance wall 29M is provided from the lower portion of the inclined wall 292 to the outlet opening portion 291, that is, a clearance space is formed outside the solid processing agent supply passage. When dew condensation occurs on the inclined wall 292, drops of water flow down on the inclined wall 292 and pass through a clearance formed between the inclined wall 292 and the water conveyance wall 29M. After that, the drops of water drip onto the processing solution surface. In this connection, the drops of water may be discharged outside the dissolution tank 2B from the water conveyance wall 29M.

Figure 21:
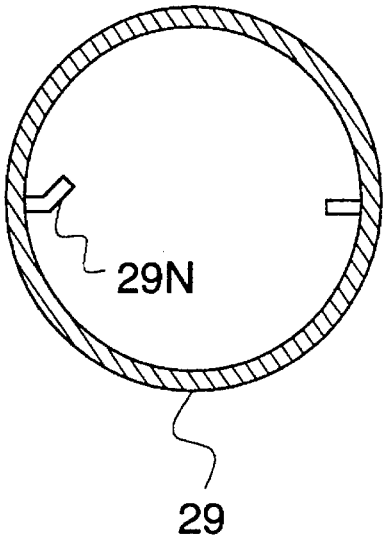
FIGS. 21(A) to 21(C) are cross sectional views of the guide member of an example.
Figure 21:
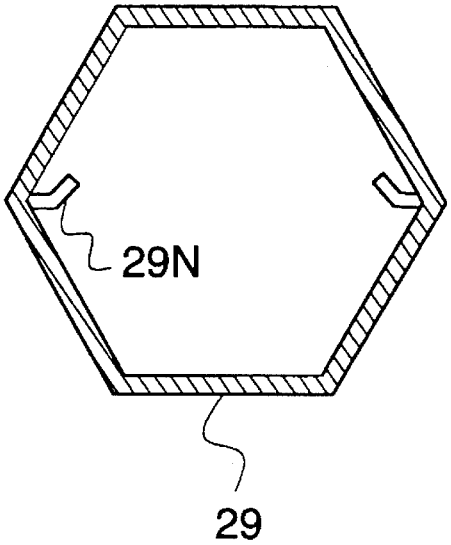
Figure 21:
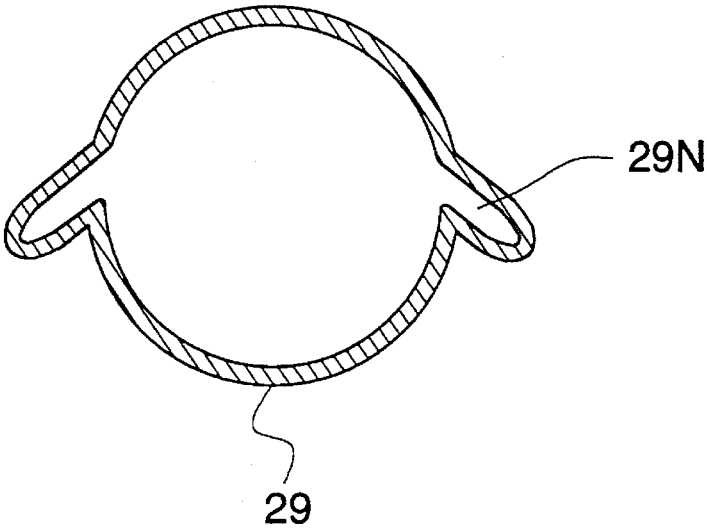

FIGS. 21(A) to 21(C) are cross sectional views showing examples of the guide member 29. FIG. 21(A) is a view showing a hollow cylindrical guide member 29 in which a gutter-shaped water conveyance section 29N is provided. FIG. 21(B) is a view showing a hollow hexagonal-pole-shaped guide member 29 in which a gutter-shaped water conveyance section 29N is provided. Dew condensation occurs on the ceiling of the guide member 29, and drops of water flow down from the ceiling and are collected by the water conveyance section 29N. Then the drops of water flow down in the longitudinal direction of the water conveyance section 29N and drop onto the processing solution surface. FIG. 21(C) is a view showing a hollow cylindrical guide member 29 in which a water conveyance section 29N is provided outside the guide member 29.

FIGS. 22(A) to 22(G) are cross sectional views for showing various examples of the guide member 29 in which a movable shutter member for opening and closing the supply passage is provided in a portion of the solid processing agent supply passage.

Figure 22:
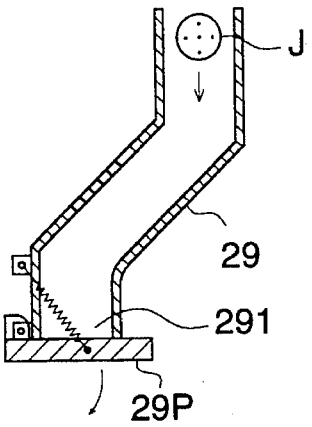
FIGS. 22(A) to 22(G) are sectional views showing various examples in which a moisture-proof movable shutter is attached to the guide member.
Figure 22:
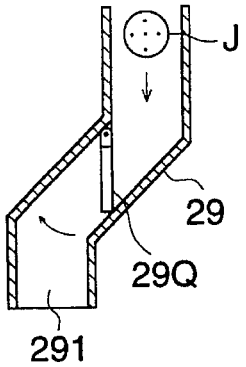
Figure 22:
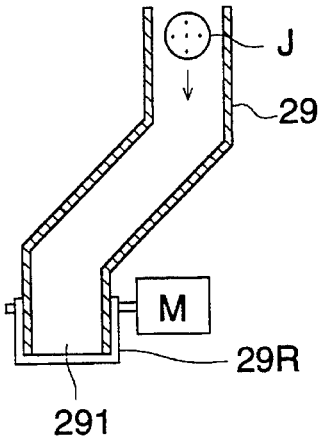
Figure 22:
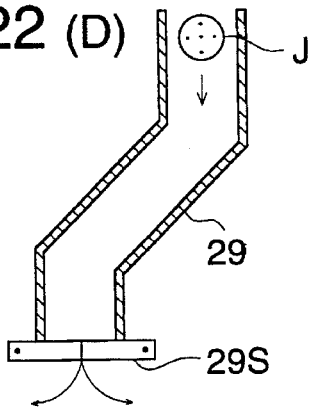
Figure 22:
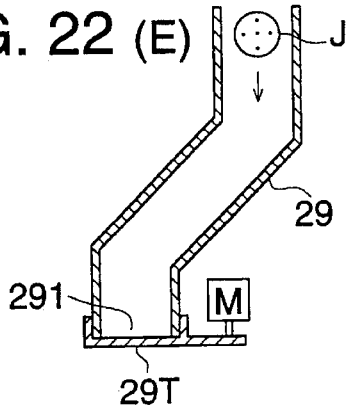
Figure 22:
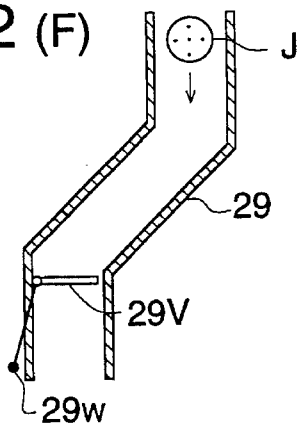
Figure 22:
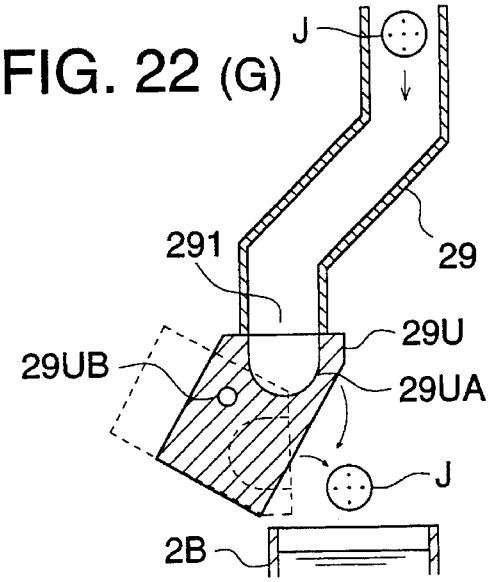

FIG. 22(A) is a view showing the guide member 29 in which a movable shutter 29P for moisture-proof is arranged at the outlet opening portion 291. The movable shutter member 29P is pulled by a spring so that the outlet opening 291 is closed. When the solid processing agent J is supplied, the shutter member 29P is open by the weight of the solid processing agent J which drops at a supply speed. After the solid processing agent J has passed through the shutter member 29P, it is closed again and a moisture-proof condition can be maintained. In this connection, the shutter member 29P may be operated by a motor or solenoid. The ventilating hole 296 described before may be appropriately provided at a position close to the ceiling of the guide member 29.

FIG. 22(B) is a view showing the guide member 29 in which a movable shutter 29Q for moisture-proof is arranged in the middle of the supply passage in the guide member 29. The movable shutter member 29Q may be pulled by a spring, however, in this case, the movable shutter member 29Q closes the supply passage by its own weight.

FIG. 22(C) is a view showing the guide member 29 of another example in which a movable shutter 29R for moisture-proof is arranged at the outlet opening portion 291. In this example, the movable shutter member 29R is oscillated around a rotational shaft arranged horizontally. In this case, the drive source of the solid processing agent replenishing means 35 is used as a power source, or alternatively an exclusive motor M or solenoid is used.

In the apparatus illustrated in FIG. 22(D), two pieces of movable shutter members 29R for moisture-proof are opened and closed around two shafts arranged close to the outlet opening portions 291. In this case, the two pieces of movable shutter members 29R for moisture-proof may be opened and closed in the same manner as that of the movable shutter members 29P by the weight of solid processing agent J and the passing speed, or alternatively by the action of a drive source.

In the apparatus illustrated in FIG. 22(E), the movable shutter member 29T for moisture-proof is substantially horizontally rotated around a vertical shaft, so that the outlet opening 291 of the guide member 29 can be opened and closed. In this case, the same drive source as that illustrated in FIG. 22(C) may be used.

In the apparatus illustrated in FIG. 22(F), the movable shutter member 29V for moisture-proof is rotatably arranged in the middle of the guide passage of the guide member 29. In this case, a weight 29W for return is mounted on a shaft of the movable shutter member 29V. Therefore, the guide passage is shielded by the shutter member except when solid processing agent J passes through the guide member. In this connection, it is preferable that the movable shutter members 29P, 29Q, 29S and 29V are opened in the direction of advance of solid processing agent J, because the shutter members do not obstruct the passage of solid processing agent J.

FIG. 22(G) is a cross sectional view of the guide member in which another example of the movable shutter member is illustrated. In the drawing, there is provided a movable shutter member 29U at a lower position of the outlet opening 291. By its own weight, the movable shutter member 29U stops and closes the outlet opening portion 291. A receiving section 29UA capable of accommodating the solid processing agent J is formed in an upper portion of the movable shutter member 29U. After the solid processing agent J has been discharged from the outlet of the solid processing agent replenishing means 35, it passes through the supply passage of the guide member 29 and is sent from the outlet opening 291 to the receiving section 29UA of the movable shutter member 29U. When the solid processing agent J is accommodated, the weight of the fore end portion of the movable shutter member 29U is increased, so that the movable shutter member 29U is oscillated around a support shaft 29UB, and the receiving section 29UA is moved downward. Therefore, the accommodated solid processing agent J is discharged into the dissolution tank 2B located downward.

Since the shutter member is opened after the solid processing agent J has come into contact with it, not only the moisture-proof effect is provided but also the dropping speed of the solid processing agent J is reduced. Accordingly, the splash from the solid processing solution surface can be preferably reduced.

As described above, in the automatic developing apparatus for developing silver halide photosensitive material of the present invention, when the solid processing agent is supplied or the apparatus waits for the following operation, the solid processing agent supply passage is prevented from being wet with a highly humid vapor or a splash rising from the processing solution surface of the processing solution tank or the dissolution tank connected with it. Further, it is possible to prevent the solid processing agent from coming into contact with drops of water created by dew condensation, so that swelling and deterioration of the solid processing agent can be prevented and photosensitive material can be stably processed by the automatic developing apparatus. Further, when the movable shutter member is provided, the solid processing agent supply passage can be maintained in a complete moisture-proof condition. Therefore, it is effective to prevent the solid processing agent from being denatured and the processing performance can be stabilized.

What is claimed is:

1. An apparatus for processing a silver halide photographic material with a processing solution, comprising:

a tank in which the processing solution is stored;

replenishing means for replenishing a solid processing agent into the processing solution in the tank in which the solid processing agent is dissolved in the processing solution, the replenishing means positioned above the level of the processing solution so that the solid processing agent is dropped from the replenishing means to the processing solution; and a guide passage constructing member comprising an inner wall surface forming and enclosing a guide passage, said guide passage constructing member being provided between the replenishing means and the processing solution and guiding the dropped solid processing agent along the enclosed guide passage and discharging the dropped solid processing agent through an exit opening of the enclosed guide passage into the processing solution, the guide passage constructing member so arranged that a part of the enclosed guide passage is inclined to a horizontal plane and having a ventilating opening to communicate between an enclosed space in the enclosed guide passage and an outer space of the enclosed guide passage separately from the exit opening.

2. The apparatus of claim 1, further comprising a processing tank in which the silver halide photographic material is processed, wherein the tank is provided in the processing tank as a dissolving section.

3. The apparatus of claim 1, wherein the ventilating opening is positioned higher than the lowest point of the inclined part of the enclosed guide passage.

4. The apparatus of claim 1, wherein the ventilating opening is provided on the highest point of the guide passage.

5. The apparatus of claim 1, wherein the enclosed guide passage has a connecting section on which the enclosed guide passage is connected with the replenishing means so as to receive the dropped solid processing agent, and the ventilating opening is provided on an entrance opening of the connecting section.

6. The apparatus of claim 1, wherein the ventilating opening is provided on a higher portion of a ceiling section of the enclosed guide passage.

7. The apparatus of claim 1, wherein the ventilating opening is provided with a pent roof.

8. The apparatus of claim 1, wherein at least a part of the ventilating opening is covered with an air filter.

9. The apparatus of claim 1, wherein the enclosed guide passage is provided with a shutter member to block a communication through the enclosed guide passage.

10. The apparatus of claim 1, wherein the guide passage constructing member is made so as to be detachable from the tank and the replenishing means.

11. The apparatus of claim 1, wherein the guide passage constructing member is arranged in relation to the level of the processing solution in such a manner that at least a part of the exit opening of the enclosed guide passage is blocked with the processing solution.

12. The apparatus of claim 11, wherein the exit opening of the enclosed guide passage is dipped in the processing solution.

13. The apparatus of claim 1, wherein the guide passage constructing member is made in one body so as to form the enclosed guide passage.

14. The apparatus of claim 1, wherein the solid processing agent is shaped in a tablet.

15. An apparatus for processing a silver halide photographic material with a processing solution, comprising:

a tank in which the processing solution is stored;

replenishing means for replenishing a solid processing agent into the processing solution in the tank in which the solid processing agent is dissolved in the processing solution, the replenishing means positioned above the processing solution so that the solid processing agent is dropped from the replenishing means to the processing solution; and a guide passage constructing member comprising an inner wall surface forming and enclosing a guide passage, said guide passage member being provided between the replenishing means and the processing solution and guiding the dropped solid processing agent along the enclosed guide passage and discharging the dropped solid processing agent through an exit opening of the enclosed guide passage into the processing solution, the guide passage constructing means including a shutter member to block communication through the enclosed guide passage.

16. The apparatus of claim 15, wherein the shutter member is opened only during a time to replenish the solid processing agent so that the solid processing agent passes through the shutter member along the enclosed guide passage, and the shutter member is closed during a time other than the replenishing time.

17. The apparatus of claim 16, wherein the shutter member starts its opening action after the solid processing agent has come in contact with at least one of the shutter member and a member movable in cooperation with the shutter member in the replenishing time.

18. The apparatus of claim 17, wherein the shutter member is kept its closed condition by one of an elastic biasing force and a weight of the shutter member or the cooperative member, and the shutter member is opened by means of at least one of a force created by the movement of the solid processing agent and a gravity of the solid processing agent.

19. An apparatus for processing a silver halide photographic material with a processing solution, comprising:

a tank in which the processing solution is stored, the tank having an open top above the processing solution;

replenishing means for replenishing a solid processing agent into the processing solution in the tank, the replenishing means positioned above the level of the processing solution so that the solid processing agent is dropped from the replenishing means to the processing solution;

a guide passage constructing member provided between the replenishing means and the processing solution and forming a guide passage, the guide passage constructing member guiding the dropped solid processing agent along the guide passage and discharging the dropped solid processing agent onto an alighting point on the processing solution, and a top cover to cover a space located vertically above the alighting point and in a vicinity of the alighting point.

20. An apparatus for processing a silver halide photographic material with a processing solution, comprising:

a tank in which the processing solution is stored;

replenishing means for replenishing a solid processing agent into the processing solution in the tank in which the solid processing agent is dissolved in the processing solution, the replenishing means positioned above the level of the processing solution so that the solid processing agent is dropped from the replenishing means to the processing solution;

a guide passage constructing member comprising an inner wall surface forming and enclosing a guide passage, said guide passage forming member being provided between the replenishing means and the processing solution and guiding the dropped solid processing agent along the enclosed guide passage and discharging the dropped solid processing agent through an exit opening of the enclosed guide passage onto an alighting point on the processing solution, and the guide passage constructing member so arranged that a part of the enclosed guide passage is inclined to a horizontal plane, whereby an area projected vertically from a region enclosed by the exit opening is sheltered by the inclined guide passage constructing member.

21. The apparatus of claim 20, wherein the tank includes a top cover to cover a space located vertically above the alighting point and a vicinity continuing to the alighting point.

22. The apparatus of claim 20, wherein the guide passage constructing member includes a ceiling member to form a ceiling section of the enclosed passage and the ceiling member has a lowest portion, and wherein the lowest portion is arranged to position in the space located vertically above the region enclosed by the exit opening.

23. The apparatus of claim 20, wherein the guide passage constructing member includes a ceiling member to form a ceiling section of the enclosed passage and a projection provided on an inner surface of the ceiling member, and wherein dew condensation takes place on the projection.

24. The apparatus of claim 20, wherein the guide passage constructing member includes a ceiling member to form a ceiling section of the enclosed passage and a guiding member to guide dew condensation taking place on an inner surface of the ceiling member to an outside of the enclosed guide passage.

* * * * *